United States Patent [19]

Mizuno

[11] 4,100,947

[45] Jul. 18, 1978

[54] APPARATUS FOR SELECTIVELY INSERTING WEFT YARNS INTO THE SHED IN A WEAVING LOOM

[75] Inventor: Yukio Mizuno, Kodiaira, Japan

[73] Assignee: Nissan Motor Company, Limited

[21] Appl. No.: 728,879

[22] Filed: Oct. 1, 1976

[30] Foreign Application Priority Data

Oct. 5, 1975 [JP] Japan ..... 50-120035
Dec. 2, 1975 [JP] Japan ..... 50-144098

[51] Int. Cl.[2] ..... D03D 47/38
[52] U.S. Cl. ..... 139/453
[58] Field of Search ..... 139/55.1, 66 R, 78, 139/80, 178, 179, 429, 435, 453; 66/132, 133

[56] References Cited

U.S. PATENT DOCUMENTS

| | | | |
|---|---|---|---|
| 3,276,482 | 10/1966 | Liebchen | 139/453 |
| 3,342,220 | 9/1967 | Bartosek et al. | 139/453 |
| 3,820,574 | 6/1974 | Mizuno | 139/435 |
| 3,885,599 | 5/1975 | Blackburn et al. | 139/435 |

*Primary Examiner*—Henry S. Jaudon
*Attorney, Agent, or Firm*—Robert E. Burns; Emmanuel J. Lobato; Bruce L. Adams

[57] ABSTRACT

An apparatus for selectively inserting weft yarns of different natures, particularly colors, into the shed of a weaving loom. The apparatus has at least two weft shooting members each movable into a position ready to shoot the pick of weft yarn into the shed. Weft selector cam means having various conditions each operative to hold each weft shooting member in the above mentioned position thereof, are provided. Cam actuating means drive the cam means between the above mentioned conditions thereof, weft selector signal supply means store signals representative of a predetermined weft inserting schedule, and locking means are responsive to the signals for locking the cam actuating means in a condition inoperative to drive the cam means in response to one of the signals and releasing the cam actuating means from such a condition in response to another signal.

19 Claims, 18 Drawing Figures

II
II
20
F
C
34a
34b
34c
34d
36
38
H
H'
W
W'
L
R
86
84
88
82
74a
74b
74
76
78
24
72
80
60
56
50d
50c
50b
52a
52b
52c
22
62
64
46
54
48d
48c
48b
48a
110b
58
(58')
68(68')
66
(66')
180b
172b
106b
104b
112b
26
114b
116b
168
94b
70
(70')
108b
102
174b
176b
98b
100b
164b
186b
160b
120b
118b
138
90b
96b
124b
166b
178b
182b
170b
122b
130
32
156b
140
92
126
158b
188b
184b
150b
162b
136
152b
154
144
146b
148b
30
142
128
28
132
134b
42'

APPARATUS FOR SELECTIVELY INSERTING WEFT YARNS INTO THE SHED IN A WEAVING LOOM

BACKGROUND OF THE INVENTION

The present invention relates in general to textile weaving looms and, particularly, to apparatus for selectively inserting weft yarns into the shed of a weaving loom of the type capable of selecting a weft yarn to be shot into the shed out of a plurality of weft yarns having different natures, particularly colors. The weaving loom into which an apparatus according to the present invention is to be incorporated is, typically, of the shuttleless type using a jet stream of fluid for shooting the pick of weft yarn into the shed. As the description proceeds, however, the weaving looms to which the present invention is applicable are not limited to the looms of such a type.

In a weaving loom capable of selectively inserting weft yarns of differnt natures into the shed, the pick of the weft yarn to be shot into the shed is selected in accordance with a prescribed schedule which is represented by signals incorporated into weft yarn selector signal supply means usually using a pattern card arrangement including a peg mounted on predetermined one of the teeth or guide faces of a sprocket wheel.

SUMMARY OF THE INVENTION

One of the important objects of the present invention is to provide, in an apparatus of the above described general nature, such an arrangement as will make it possible to convert the above mentioned signals into rotational motions of cam means and further convert the rotational motions into substantially linear reciprocating motions for driving weft shooting means into position aligned with the weaving shed.

Another important object of the present invention is to minimize the motions, particularly the distances of movements, involved in converting the rotational motions of the cam means into the linear reciprocating motions.

Still another object of the invention is to eliminate or lessen mechanical shocks and impacts produced in driving the cam means from the rest condition thereof.

In accordance with the present invention, these objects are accomplished basically in an apparatus comprising, in combination, a weft insertion unit including a plurality of weft shooting members each movable into a position substantially aligned with the weaving shed of the loom, weft selector cam means having a plurality of conditions respectivley operative to hold the weft shooting members in their respective positions aligned with the shed, a link mechanism operatively connecting the cam means to the weft insertion unit for moving selected one of the weft shooting nozzles into the position aligned with the shed when the cam means is actuated from one of said conditions into another, cam actuating means operative to drive the cam means between the aforesaid conditions thereof in each cycle of operation of the loom, weft selector signal supply means storing signals representative of a predetermined schedule in accordance with which the weft yarns are to be selectively inserted into the shed, and locking means responsive to the signals delivered from the signal supply means for locking the cam actuating means in a condition inoperative to drive the cam means in response to one signal from the signal supply means and releasing the cam actuating means from the inoperative condition in response to another signal from the signal supply means.

The cam means comprises lobular cams respectively associated with prescribed ones of the weft shooting members and rotatable independently of each other about a common fixed axis, each of the cams having a plurality of cam lobe portions substantially equiangularly spaced apart from each other across bottom portions about the fixed axis and having substantially equal radii from the axis, the bottom portions of all of the cams have substantially equal radii from the fixed axis and the respective radii of the cam lobe portions of the cams being different from each other. In this instance, the above mentioned link mechsnism comprises cam followers which are respectively engageable with the lobular cams for being raised and lowered over the aforesaid fixed axis independently of each other depending upon the respective angular positions of the cams relative to the associated cam followers. Each of the lobular cams may have fixed on one end face thereof pins projecting from the end face substantially in parallel with the aforesaid fixed axis and arranged substantially in symmetry about the fixed axis, the cam actuating means comprise cam actuating units each engageable with the pins on each of the cams and movable with respect to the fixed axis for turning each of the pins on the associated cam through an angle equal to the central angle between everry neighboring two of the pins about the fixed axis and thereby driving the associated cam to rotate through the above mentioned angle about the fixed axis in each cycle of operation provided the cam actuating unit is disengaged from the locking means.

As an alternative, the cam means may comprise at least one lobular cam rotatable about a fixed axis and formed with a plurality of cam lobe portions substantially equiangularly spaced apart from each other across bottom portions about the axis and having substantially equal radii from the axis, the bottom portions having from said axis substantially equal radii smaller than the radii of the cam lobe portions. In this instance, the above mentioned link mechanism comprises a cam follower held in contact with the cam surface of the lobular cam for being alternately raised and lowered over the aforesaid axis depending upon the angular position of the cam relative to the cam follower. The lobular cam may have fixed on one end face thereof pins projecting from the end face substantially in parallel with the fixed axis of the cam and arranged substantially in symmetry about the axis, the cam actuating means being engageable with the pins and movable with respect to the fixed axis for turning each of the pins through an angle equal to the central angle between every neighboring two of the pins about the fixed axis and thereby driving the cam to rotate through the aforesaid angle about the fixed axis in each cycle of operation provided the cam actuating means is disengaged from the locking means.

BRIEF DESCRIPTION OF THE DRAWINGS

The features and advantages of an apparatus according to the present invention will be more clearly understood from the following description taken in conjunction with the accompanying drawings in which like reference numerals and characters designate corresponding parts, members, structures and means throughout the figures and in which:

FIGS. 3A to 6A are schematic views showing various operative conditions of the cam assembly incorporated into the embodiment of FIGS. 1 and 2;

FIGS. 3B to 6B are schematic views showing the conditions of the weft insertion unit of the embodiment of FIGS. 1 and 2 as achieved in correspondence with the operative conditions of the cam assembly as illustrated in FIGS. 3A to 6A, respectively;

DESCRIPTION OF THE PREFERRED EMBODIMENTS

Figure 1:
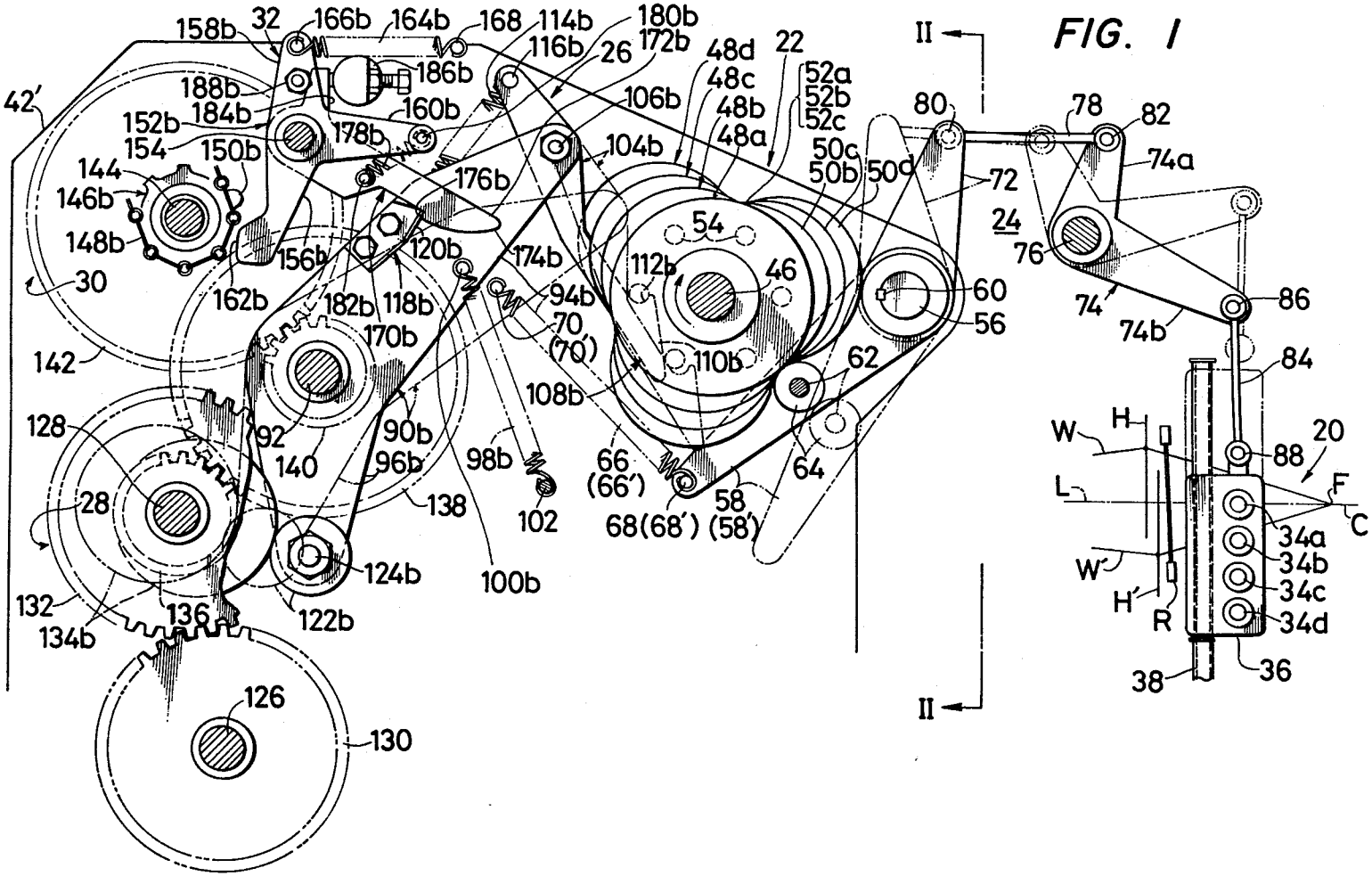
FIG. 1 is a side elevational view showing, partly in cross section, a first preferred embodiment of an apparatus according to the present invention.

The constructions and the modes of operation of the preferred embodiments of the present invention will be hereinafter described with reference to the accompanying drawings. In the drawings, the majority of conventional parts and structures constructing a weaving loom into which each of the embodiments of the present invention is to be incorporated is omitted for the sake of clarity. The relative positions of the individual parts and structures constituting each embodiment will however be apparent to those skilled in the art from the directions in which the webs (designated by W and W' in FIGS. 1 and 7) of warp yarns extend. In each of FIGS. 1 and 7, the webs W and W' are alternately raised and lowered across a warp line L by means of weaving healds H and H', respectively, and form a shed S which is closed at the fell F of a woven cloth C. As is customary in the art, the warp line L is assumed to be substantially horizontal. Designated by R is a weaving reed which is adapted to hold the webs W and W' of warp yarns in position forming the shed S and to beat up the pick of a weft yarn (not shown) to the fell F of the woven cloth C when the pick of the weft yarn is shot into the shed S, as is well known in the art.

Figure 2:
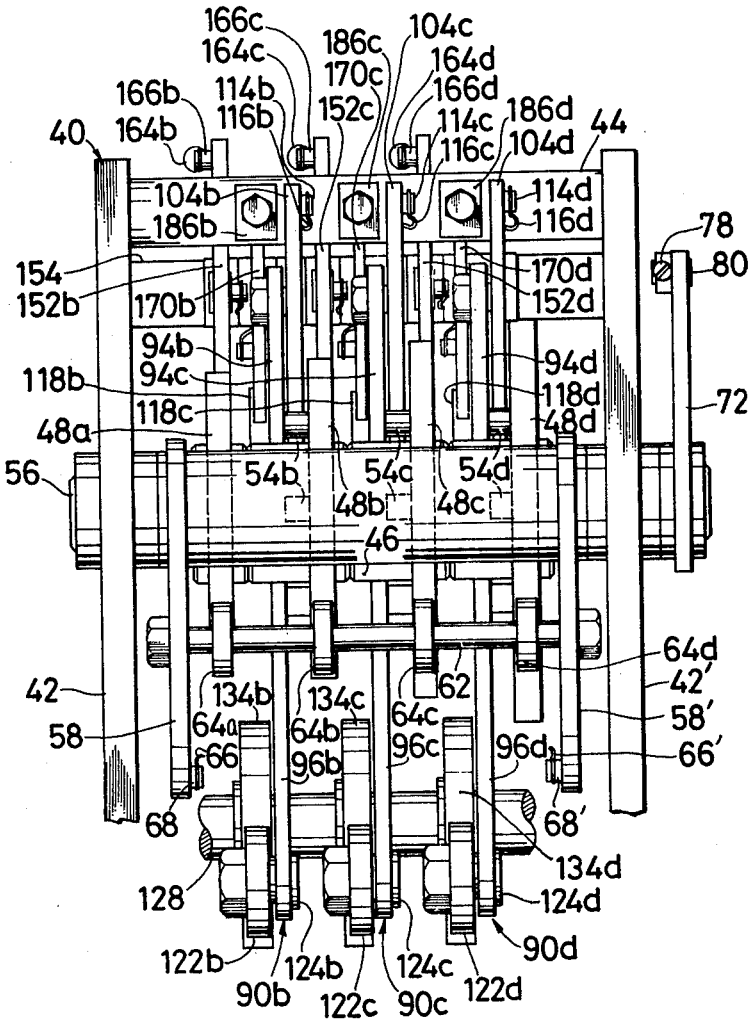
FIG. 2 is a view showing the embodiment of FIG. 1 as viewed from a vertical plane indicated by II—II in FIG. 1.

Referring to FIGS. 1 and 2, a first preferred embodiment of the present invention is shown largely comprising a weft insertion unit 20, a weft selector cam assembly 22, a link mechanism 24 provided between the weft insertion unit 20 and the cam assembly 22, cam actuating means 26 for actuating the cam assembly 22 into various operational conditions, intermittent-motion drive means 28 for driving the cam actuating means 26, program-operated weft selector signal supply means 30, and locking means 32 for locking and releasing the cam actuating means 26 in response to the signals delivered from the signal supply means 30. The embodiment illustrated in FIGS. 1 and 2 is assumed, by way of example, to be arranged to be capable of handling four weft yarns of different natures, particularly colors and, thus, the weft insertion unit 20 is shown comprising first, second, third and fourth weft shooting nozzles 34*a*, 34*b*, 34*c* and 34*d* commonly mounted on a movable carrier 36. The carrier 36 is vertically movable in close proximity to one lateral end of the weaving shed S so that any one of the weft shooting nozzles 34*a*, 34*b*, 34*c* and 34*d* is selectively located on the warp line L and aligned with the weaving shed S. Each of the weft shooting nozzles 34*a*, 34*b*, 34*c* and 34*d* is adapted to detain therein a pick of weft yarn leading from a yarn supply package through a weft drawing and measuring arrangement (not shown) as is customary. The carrier 36 has further mounted thereon a fluid feed duct 38 leading from a source of fluid under pressure. When the carrier 36 is moved upwardly or downwardly so that any one of the weft shooting nozzles 34*a*, 34*b*, 34*c* and 34*d* is located in line with the weaving shed S, communication is provided between the fluid feed duct 38 and the particular one of the nozzles and the pick of the weft yarn which has been detained in the nozzle is shot into the shed S by the jet stream of fluid ejected from the particular nozzle.

The weft selector cam assembly 22, link mechanism 24, cam actuating means 26, drive means 28, signal supply means 30 and locking means 32 are supported by a support structure 40 which is shown in FIG. 2 as comprising a pair of spaced parallel vertical wall members 42 and 42' and a horizontal cross member 44 interconnecting the vertical wall members 42 and 42'.

The weft selector cam assembly 22 comprises a fixed horizontal cam shaft 46 extending between the vertical wall members 42 and 42' of the above mentioned support structure 40 and secured at its opposite ends to the wall members 42 and 42', though not seen in FIGS. 1 and 2. The cam assembly 22 further comprises a circular first cam 48*a* and lobular second, third and fourth cams 48*b*, 48*c* and 48*d*. The cams 48*a*, 48*b*, 48*c* and 48*d* are concentrically mounted on the cam shaft 46 and are rotatable independently of each other about the center axis of the shaft 46. Each of the lobular second, third and fourth cams 48*b*, 48*c* and 48*d* has a plurality of arcuate cam lobe portions (herein shown as three in number by way of example) which have equal radii of curvature and equal central angles about the center axis of the cam shaft 46 and which are substantially equiangularly spaced apart from each other about the center axis of the cam shaft 46 across intermediate bottom portions which also have a common radius of curvature and equal central angles about the center axis of the cam shaft 46. The cam lobe portions of the lobular second, third and fourth cams 48*b*, 48*c* and 48*d* are designated by 50*b*, 50*c* and 50*d*, respectively, and the bottom portions of the cams 48*b*, 48*c* and 48*d* are designated by 52*b*, 52*c* and 52*d*, respectively, in FIG. 1. While the radii of the bottom portions 52*b*, 52*c* and 52*d* of the lobular cams 48*b*, 48*c* and 48*d* from the center axis of the cam shaft 46, the respective radii of the cam lobe portions 50*b*, 50*c* and 50*d* of the lobular second, third and fourth cams 48*b*, 48*c* and 48*d* from the center axis of the cam shaft 46 are larger in this sequence, as will be clearly seen in FIG. 1. The circular cam 48*a* has a radius which is substantially equal to the common radius of the bottom portions of the lobular cams 48*b*, 48*c* and 48*d*.

Each of the lobular cams 48*b*, 48*c* and 48*d* is assumed to be provided with three cam lobe portions which are substantially equidistantly spaced apart from each other about the center axis of the cham shaft 46 as above mentioned. The vertices of the individual cam lobe portions of each lobular cam are, therefore, spaced apart 120° from each other about the center axis of the cam shaft 46 and, as a consequence, there is established a central angle of approximately 60° between the vertex of each of the cam lobe portions of each lobular cam and each of the bottom portions into which the cam lobe portion merges. While the number of the cam lobe portions of each lobular cam may be varied as desired, it is important that the cams consisting of one circular cam and one or more lobular cams be provided in a number equal to the number of the weft shooting nozzles provided in the weft insertion unit 20 and that, if the cams include two or more lobular cams, all the lobular cams be provided with the same number of cam lobe portions. As will be understood as the description proceeds, the circular cam 48*a* is provided for being utilized for a weaving operation using only one weft yarn. If, therefore, the apparatus embodying the present invention is to be utilized solely for weaving operations using a plurality of weft yarns having different natures, the circular cam 48*a* may be dispensed with.

The cams 48*a*, 48*b*, 48*c* and 48*d* are spaced apart from each other in a direction parallel with the center axis of the cam shaft 46 as will be seen in FIG. 2 and each of the lobular cams 48*b*, 48*c* and 48*d* is provided with a plurality of pins which are indicated by dotted lines and representatively designated by reference numeral 54 in FIG. 1. The pins 54 project from one end face of each lobular cam substantially in parallel with the center axis of the cam shaft 46 as will be seen in FIG. 2 in which the pins on the lobular second, third and fourth cams 48*b*, 48*c* and 48*d* are specifically designated by 54*b*, 54*c* and 54*d*, respectively. The pins 54 on each of the lobular cams 48*b*, 48*c* and 48*d* are provided in a number doubling the number of the cam lobe portions of each lobular cam and are arranged substantially in symmetry about the center axis of the cam shaft 46. Each lobular cam being herein assumed as three in number as above described, the pins 54 are shown as six in number for each of the lobular cams as is seen in FIG. 1. The pins 54 on each lobular cam are, thus, spaced apart 60° from each other about the center axis of the cam shaft 46.

The previously mentioned link mechanism 24 provided between the weft insertion unit 20 and the weft selector cam assembly 22 thus arranged comprises a horizontal shaft 56 rotatable about its center axis which is substantially parallel with the center axis of the above mentioned cam shaft 46. The rotatable shaft 56 has its end portions journalled to the vertical wall members 42 and 42' of the support structure 40 as shown in FIG. 2 and has securely mounted thereon a pair of spaced parallel arms 58 and 58' which are keyed as at 60 to the rotatable shaft 56 as shown in FIG. 1. The parallel arms 58 and 58' are thus rotatable with the shaft 56 on vertical planes perpendicular to the center axis of the cam shaft 46. The arms 58 and 58' extend generally downwardly from the rotatable shaft 56 and have securely carried on their respective intermediate portions a shaft 62 which extends in parallel with that portion of the cam shaft 46 which supports the cams 48*a*, 48*b*, 48*c* and 48*d* as will be seen in FIG. 2. The shaft 62 has mounted thereon first, second, third and fourth rollers 64*a*, 64*b*, 64*c* and 64*d* which are rotatable on the shaft 62 and which are arranged in alignment with the cams 48*a*, 48*b*, 48*c* and 48*d*, respectively, as shown in FIG. 2. In FIG. 1, the rollers 64*a*, 64*b*, 64*c* and 64*d* are representatively designated by 64 for simplicity of illustration. The rollers 64*a*, 64*b*, 64*c* and 64*d* are engageable with the cams 48*a*, 48*b*, 48*c* and 48*d*, respectively, depending upon the rotational positions of the individual cams about the center axis of the cam shaft 46 and, thus, serve as cam followers for the cams 48*a*, 48*b*, 48*c* and 48*d*, respectively. When the lobular second, third and fourth cams 48*b*, 48*c* and 48*d* concurrently have angular positions which are in phase with each other with their respective bottom portions 52*b*, 52*c* and 52*d* aligned with each other in parallel with the center axis of the cam shaft 46 and have the bottom portions 52*b*, 52*c* and 52*d* contacted by the second, third and fourth cam follower rollers 64*b*, 64*c* and 64*d*, respectively, the first cam follower roller 64*a* is in contact with the outer peripheral surface of the circular first cam 48*a*, as will be seen from FIG. 1. When the cam follower rollers 64*a*, 64*b*, 64*c* and 64*d* are held in these positions, the parallel arms 58 and 58' supporting the rollers assume clockwise extreme rotational positions in FIG. 1 about the center axis of the rotatable shaft 56. Such rotational positions of the parallel arms 58 and 58' are herein referred to as first angular positions of the arms 58 and 58' about the center axis of the rotatable shaft 56. When the lobular second cam 48*b* is rotated about the center axis of the cam shaft 46 from the above described conditions and assumes an angular position having one of its cam lobe portions 50*b* in contact with the cam follower roller 64*b* associated therewith, all the cam follower rollers 64*a*, 64*b*, 64*c* and 64*d* supported on the shaft 62 are raised away from the center axis of the center axis of the cam shaft 64 so that the cam follower rollers 64*c* and 64*d* associated with the lobular third and fourth cams 48*c* and 48*d* are moved away from the bottom portions 52*c* and 52*d* of the cams 48*c* and 48*d*, respectively, and at the same time the first cam follower roller 64*a* is moved away from the outer peripheral surface of the circular first cam 48*a*. This causes the parallel arms 58 and 58' to turn about the center axis of the rotatable shaft 56 counter-clockwise of FIG. 1 from the above mentioned first angular positions. The rotational positions of the parallel arms 58 and 58' thus achieved are herein referred to as second angular positions of the arms 58 and 58' about the center axis of the rotatable shaft 56. When, furthermore, the lobular fourth cam 48*d* is held in an angular position having one of its bottom portions 52*d* confronting the cam follower roller 64*d* associated therewith and at the same time the lobular third cam 48*c* is held in an angular position having one of its cam lobe portions 50*c* contacted by the associated cam follower roller 64*c*, then the rollers 64*a*, 64*b*, 64*c* and 64*d* and accordingly the shaft 62 carrying the rollers are further raised away from the center axis of the cam shaft 46 so that the parallel arms 58 and 58' assume angular positions which are rotated counter clockwise of FIG. 1 from the above mentioned second angular positions thereof about the center axis of the rotatable shaft 56. The positions of the parallel arms 58 and 58' thus achieved are herein referred to as third angular positions of the arms 58 and 58' about the center axis of the rotatable shaft 56. The third angular positions of the arms 58 and 58' are achieved irrespective of the angular position of the second lobular cam 48*b*. When the lobular fourth cam 48*d* is rotated about the center axis of the cam shaft 46 into an angular position having one of its cam lobe portions 50*d* contacted by the cam follower roller 64*d* associated therewith, the rollers 64*a*, 64*b*, 64*c* and 64*d* and the shaft 62 are still further raised away from the center axis of the cam shaft 46 so that the parallel arms 58 and 58' are turned counter clockwise from the above mentioned third angular positions thereof about the center axis of the rotatable shaft 56. The rotational positions thus reached by the parallel arms 58 and 58' are herein referred to as fourth angular positions of the arms 58 and 58' about the center axis of the rotatable shaft 56. The fourth angular positions of the arms 58 and 58' are the counter-clockwise extreme rotational positions of the arms 58 and 58' in FIG. 1 and are achieved irrespective of the angular positions of the lobular second and third cams **48*b* and 48*c*. The parallel arms 58 and 58' are thus stepwise rotatable with the rotatable shaft 56 about the center axis of the shaft 56 between the above mentioned first, second, third and fourth angular positions thereof or, in other words between the two extreme rotational positions through the second and third angular positions as intermediate rotational positions depending upon the angular positions of the individual lobular cams 48*b*, 48*c* and 48*d*. The arms 58 and 58' are biased to turn counter clockwise of FIG. 1 about the center axis of the rotatable shaft 56 by suitable biasing means such as preloaded helical tension springs 66 and 66' which are anchored each at one end to spring retaining pins 68 and 68' secured to leading end portions of the parallel arms 58 and 58', respectively, and at the other end to spring retaining pins 70 and 70' which are secured to the vertical wall members 42 and 42', respectively, of the support structure 40 though not shown in FIGS. 1 and 2**.

The link mechanism 24 further comprises a control arm 72 which is securely mounted on one end portion of the above described rotatable shaft 56 and which is thus rotatable with the shaft 56 and accordingly with the parallel arms 58 and 58' about the center axis of the shaft 56. As the parallel arms 58 and 58' are rotated about the center axis of the rotatable shaft 56 between the clockwise and counter-clockwise extreme rotational positions which are indicated by full and phantom lines, respectively, in FIG. 1 as above described, the control arm 72 is also rotated about the center axis of the shaft 56 between clockwise and counter-clockwise rotational positions indicated by full and phantom lines, respectively. The link mechanism 24 still further comprises a bell crank lever 74 which has an intermediate fulcrum portion rotatably mounted on a horizontal fixed shaft 76 which has a center axis substantially parallel with the center axis of the rotatable shaft 56 and which is fixedly supported by a suitable stationary member (not shown) which may form part of the loom construction. The bell crank lever 74 has an upper first arm portion **74*a* extending generally upwardly from the intermediate fulcrum portion of the lever 74 and a lower second arm portion 74*b* extending generally sidewise from the fulcrum portion and angularly spaced apart from the first arm portion 74*a* about the center axis of the fixed shaft 76, the second arm portion 74*b* having its leading end located above the carrier 36 of the previously described weft insertion unit 20, as shown in FIG. 1. A connecting rod 78 is pivotally connected at one end to the leading end of the control arm 72 by a pivotal pin 80 and at the other end to the leading end of the first arm portion 74*a* of the bell crank lever 74 by a pivotal pin 82. The pivotal pins 80 and 82 having center axes which are substantially parallel with the center axes of the shafts 56 and 76, the rotation of the control arm 72 between the clockwise and counter-clockwise extreme rotational positions about the center axis of the rotatable shaft 56 is followed by the rotation of the bell crank lever 74 between clockwise and counter-clockwise extreme rotational positions indicated by full and phantom lines, respectively, in FIG. 1 about the center axis of the fixed shaft 76. Thus, the control arm 72 and the bell crank lever 74 have their respective first, second, third and fourth angular positions which correspond respectively to the previously mentioned first, second, third and fourth angular positions of the parallel arms 58 and 58'. As the bell crank lever 74 is thus rotated counter-clockwise of FIG. 1 from the first angular position thereof about the center axis of the fixed shaft 76, the leading end of the second arm portion 74*b* of the bell crank lever 74 is moved upwardly over the previously mentioned carrier 36 forming part of the weft insertion unit 20. The rotational motion of the bell crank lever 74 is transmitted to the carrier 36 of the weft insertion unit 20 by a generally vertical actuating rod 84 which is pivotally connected at its upper end to the leading end of the second arm portion 74*b* of the bell crank lever 74 by a pivotal pin 86 and at its lower end to the carrier 36 of the weft insertion unit 20 by a pivotal pin 88, the pivotal pins 86 and 88 having center axes substantially parallel with the fixed shaft 76 supporting the bell crank lever 74. The carrier 36 of the weft insertion unit 20 is thus moved vertically between predetermined lowermost and upper most positions as the bell crank lever 74 is turned about the center axis of the fixed shaft 76 between the above mentioned clockwise and counter-clockwise extreme rotational positions thereof. When, for example, the parallel arms 58 and 58' and accordingly the bell crank lever 74 are held in the first angular positions (viz., the clockwise extreme rotational positions) thereof, the carrier 36 of the weft insertion unit 20 is held in the lowermost position and has the first weft shooting nozzle 34 located in alignment with the weaving shed S between the webs W and W' of warp yarns, as indicated by full lines in FIG. 1. As the parallel arms 58 and 58' and the bell crank lever 74 of the link mechanism 24 are rotated from the first angular positions into their respective second angular positions thereof and from the second angular positions into the third angular positions thereof, the carrier 36 of the weft insertion unit 20 is upwardly moved so that the second weft shooting nozzle 34*b* and then the third weft shooting nozzle 34*c* are brought into alignment with the weaving shed S. When the parallel arms 58 and 58' and the bell crank lever 74 are moved into the fourth angular positions, viz., the counter-clockwise extreme rotational positions thereof, the carrier 36 of the weft insertion unit 20 is moved into the uppermost position thereof as indicated by phantom lines in FIG. 1 and has the fourth weft shooting nozzle 34*d* located in alignment with the weaving shed S. The first, second, third and fourth weft shooting nozzles 34*a*, 34*b*, 34*c* and 34*d* of the weft insertion unit 20 are in this fashion selectively brought into alignment with the weaving shed S depending upon the angular positions of the lobular second, third and fourth cams 48*a*, 48*c* and 48*d* of the cam assembly 22. When each of the weft shooting nozzles 34*a*, 34*b*, 34*c* and 34*d*** is thus in alignment with the weaving shed S, the center axis of the nozzle is substantially flush with the warp line L.

The above described angular positions of the individual lobular cams **48*b*, 48*c* and 48*d* are achieved by the actions of the previously mentioned cam actuating means 26. The cam actuating means 26 consists of three cam actuating units which are respectively associated with the lobular second, third and fourth cams 48*b*, 48*c* and 48*d*. Such cam actuating units are constructed and arranged all similarly to each other and, for this reason, description will be herein made mainly in respect of the construction and arrangement of the cam actuating unit associated with the lobular second cam 48b** so as to avoid prolixity of description.

Referring to FIG. 1, the cam actuating unit for the second cam 48b comprises a rocker 90b which has an intermediate fulcrum portion rotatably mounted on a horizontal stationary shaft 92 having a center axis which is substantially parallel with the center axis of the previously described cam shaft 46. The rockers provided in association with the third and fourth cams 48c and 48d are designated by 90c and 90d in FIG. 2 and are also mounted on the above mentioned shaft 92. The rockers 90b, 90c and 90d are rotatable independently of each other on the rotatable shaft 92 about the center axis of the shaft 92 and are spaced apart from each other along the center axis of the shaft 92 at distances which are substantially equal to the spacings between the second, third and fourth cams 48b, 48c and 48d, respectively, as are seen in FIG. 2. Though not seen in the drawings, the stationary shaft 92 has opposite end portions journalled to the vertical wall members 42 and 42' of the support structure 40 shown in FIG. 2. Reverting to FIG. 1, the rocker 90b has an upper first arm portion 94b extending generally upwardly from the fulcrum portion of the rocker 90b and a lower second arm portion 96b extending generally downwardly from the fulcrum portion and angularly spaced apart from the first arm portion 94b about the center axis of the shaft 92. The first arm portions of the rockers 90c and 90d associated with the third and fourth cams 48c and 48d are designated by 94c and 94d, respectively, and likewise the second arm portions of the rockers 90c and 90d are designated by 96c and 96d, respectively, in FIG. 2. Each of the rockers 90b, 90c and 90d is rotatable about the center axis of the stationary shaft 92 between counter-clockwise and clockwise limit rotational positions which are indicated by full and phantom lines, respectively, in FIG. 1 for the rocker 90b, the counter-clockwise and clockwise limit rotational positions of each rocker being herein referred to as first and second limit angular positions, respectively, of the rocker about the center axis of the stationary shaft 92. The rocker 90b is urged to turn about the center axis of the shaft 92 in clockwise direction in FIG. 1, viz., toward the second limit angular position thereof by suitable biasing means such as a preloaded helical tension spring 98b which is shown anchored at one end to a spring retaining pin 100b fixedly mounted on the upper first arm portion 94b of the rocker 90b and at the other end to a spring retaining pin 102 which is, though not shown, fixed to the vertical wall members 42 and 42' of the support structure 40 shown in FIG. 2. Each of the remaining rockers 90c and 90d is also urged in the same direction by biasing means arranged similarly to the above described biasing means for the rocker 90b, though not shown in the drawings. The pin 102 is common to all the biasing means for the rockers 90b, 90c and 90d. When each of the rockers 90b, 90c and 90d thus arranged is turned between the above mentioned first and second limit angular positions thereof about the center axis of the stationary shaft 92, the leading end of the upper first arm portion of the rocker is moved in an arc generally toward and away from the cam shaft 46 and at the same time the leading end of the lower second arm portion of the rocker is moved in an arc generally in horizontal direction as will be readily understood from the illustration in FIG. 1.

The rocker 90b associated with the second cam 48b has mounted at the leading end of its upper first arm portion 94b an elongated cam actuating member 104b by a pivotal pin 106b having a center axis which is substantially parallel with the center axis of the stationary shaft 92 on which the rocker 90b is supported. The cam actuating member 104b is thus rotatable on the rocker 90b about the center axis of the pivotal pin 106b and is movable, together with the rocker 90b, relative to the cam shaft 46 on a vertical plane perpendicular to the center axes of the cam shaft 46 and the stationary shaft 92. The cam actuating member 104b has a hook portion 108b formed with a guide surface 110b slanting from the lower end of the cam actuating member 104b and terminating in a substantially semicircular notch 112b facing the pivotal pin 106b, as indicated by dotted lines in FIG. 1. The hook portion 108b of the cam actuating member 104b is located and movable in the circular path of the pins 54b on the second cam 48b about the center axis of the cam shaft 46 and is thus capable of receiving one of the pins 54b on the guide surface 110b or in the notch 112b thereof depending upon the relative positions of the cam actuating member 104b and the second cam 48b to each other. The rockers 90c and 90d associated with the third and fourth cams 48c and 48d are also connected to cam actuating members 104c and 104d, respectively, which are arranged and configured similarly to the above described cam actuating member 104b and which are located and movable in the circular paths of the pins 54c and 54d on the third and fourth cams 48c and 48d, respectively, about the center axis of the cam shaft 46, as will be understood from the illustration in FIG. 2. The cam actuating member 104b is urged to turn about the center axis of the pivotal pin 106b on the rocker 90b counter-clockwise in FIG. 1 and, thus, has its hook portion 108b biased to move toward the cam shaft 46 by suitable biasing means such as a preloaded helical tension spring 114b which is shown anchored at one end to the upper end portion of the cam actuating member 104b by a spring retaining pin 116b and at the other end to a pin (not shown) secured to the first arm portion 94b of the rocker 90b. When one of the pins 54b on the second cam 48b is in contact with the guide surface 110b or captured in the notch 112b of the cam actuating member 104b as above mentioned, the hook portion 108b of the cam actuating member 104b is thus pressed onto the particular pin 54b at the guide surface 110b or the notch 112b by the force of the tension spring 114b. Similar biasing means are provided for the cam actuating members 104c and 104b associated with the third and fourth cams 48c and 48d, including tension springs 114c and 114d, respectively, which are anchored each at one end to spring retaining pins 116c and 116d on the cam actuating members 104c and 104d, respectively, and at the other ends to pins (not shown) on the respective upper first arm portions 94c and 94d of the rockets 90c and 90d.

For the reason to be explained later, the rocker 90b has a land 118b which is fixedly mounted on one face of the upper first arm portion 94b of the rocker by suitable fastening means such as bolts as shown. The land 118b has a substantially flat surface portion 120b which is found on or may be slightly inclined to a plane passing through the center axis of the stationary shaft 92. The rockers 90c and 90d associated with the third and fourth cams 48c and 48d are also provided with lands 118c and 118d, respectively, as shown in FIG. 2 and are formed with surface portions (not shown) which are similar to the above described surface portion 120b of the land 118b on the rocker 90b. The rocker 90b has mounted at the leading end of its lower second arm portion 96b a roller 122b which is rotatable on a shaft 124b having a center axis substantially parallel with the center axis of the stationary shaft 92 on which the rocker 90b is mounted. Similar rollers 122c and 122d are rotatably mounted on shafts 124c and 124d which are secured to the lower arm portions 96c and 96d of the rockers 90c and 90d, respectively, as shown in FIG. 2. The respective center axes of the shafts 124b, 124c and 124d are in line with each other and the rollers 122b, 122c and 122d mounted on these shafts have equal diameters as will be seen from FIG. 2.

The intermittent-motion drive means 28 is adapted to drive the above described rockers 90b, 90c and 90d between the previously described first and second or counter-clockwise and clockwise limit angular positions thereof and comprises a horizontal drive shaft 126 and a horizontal cam shaft 128. The shafts 126 and 128 are rotatable about their respective center axes which are substantially parallel with the center axis of the stationary shaft 92 supporting the individual rockers 90b, 90c and 90d. The shafts 126 and 128 have securely mounted thereon gears 130 and 132 respectively which are constantly in mesh with each other. The drive shaft 126 is connected to a drive source (not shown) of the loom and is driven to rotate about its center axis at a predetermined velocity which is proportional the velocities at which other rotatable or movable members and structures of the loom are to be driven. On the other hand, the cam shaft 128 has further securely supported thereon eccentric cams 134b, 134c and 134d which are spaced apart from each other in the axial direction of the shaft 128 and which are aligned with the rollers 122b, 122c and 122d on the rockers 90b, 90c and 90d, respectively. As will be seen from FIG. 1 in which only the eccentric cam 134b is shown, each of the eccentric cams 134b, 134c and 134d has higher and lower semicircular lobe portions having respective vertices which are diametrically opposed to each other across the center axis of the shaft 128. The eccentric cams 134b, 134c and 134d are mounted on the shaft 128 in such a manner as to have the same angular positions about the center axis of the shaft 128 so that the vertices of the higher lobe portions and the vertices of the lower lobe portions thereof are in line with each other in parallel with the center axis of the shaft 128. The roller 122b, 122c and 122d on the rockers 90b, 90c and 90b are engageable with the cams 134b, 134c and 134d, respectively, depending upon the relative angular positions of each of the rockers 90b, 90c and 90d about the center axis of the rotatable shaft 92 and each of the cams 134b, 134c and 134d about the center axis of the cam shaft 128. The rollers 122b, 122c and 122d thus serve as cam followers for the individual eccentric cams 134b, 134c and 134d, respectively. When the drive shaft 126 is driven for rotation about its center axis, the rotational motion of the shaft 126 is transmitted through the gears 130 and 132 to the cam shaft 128 and from the cam shaft 128 to each of the eccentric cams 134b, 134c and 134d so that, if any one of the cam follower rollers 122b, 122c and 122d on the rockers 90b, 90c and 90d is in rolling contact with the associated eccentric cam, the center axis of the pivotal pin supporting the particular cam follower roller is alternately raised and lowered over the center axis of the cam shaft 128 as the cam is rotated about the center axis of the shaft 128 and has its higher and lower lobe portions alternately contacted by the cam follower roller. As the pivotal pin on one of the rockers 90b, 90c and 90d is thus moved in an arc toward and away from the center axis of the cam shaft 128, the particular rocker is, as a whole, caused to oscillate about the center axis of the stationary shaft 92 between the previously mentioned first and second limit angular positions thereof independently of the other rockers. Each of the cam follower rollers 122b, 122c and 122d is urged to move toward the center axis of the cam shaft 128 for contacting the associated eccentric by the force of each of the preloaded tension springs 98b, 98c and 98d connected to the rockers 90b, 90c and 90d, respectively.

On the other hand, the previously mentioned weft selector signal supply means 30 comprises a gear arrangement which is shown consisting of a gear 136 securely mounted on the cam shaft 128 coaxially with the previously mentioned gear 132 on the shaft 128, coaxial gears 138 and 140 rotatably mounted on the stationary shaft 92 and integral with or securely connected to each other, and a gear 142 securely mounted on a horizontal stationary shaft 144 having a center axis which is substantially parallel with the center axis of the stationary shaft 92. The coaxial gears 132 and 136 on the cam shaft 128 are herein referred to as first and second gears, respectively, on the shaft 128 and likewise the coaxial gears 138 and 140 on the stationary shaft 92 are referred to as first and second gears, respectively, on the shaft 92. The second gear 136 on the cam shaft 128 is in mesh with the first gear 138 on the stationary shaft 92 and the second gear 140 on the stationary shaft 92 is in mesh with the gear 142 on the stationary shaft 144. The rotational motion of the first gear 132 on the cam shaft 128 is thus transmitted through the second gear 136 on the shaft 128 to the first gear 138 on the stationary shaft 92 and the rotational motion of the gear 138 thus driven by the gear 136 is, in turn, transmitted through the second gear 140 on the shaft 92 to the gear 142 on the stationary shaft 144. The gear ratio between the gear 130 on the drive shaft 126 and the first gear 132 on the cam shaft 128 is herein assumed, by way of example, to be 1:1 and the gear ratios between the second gear 136 on the cam shaft 128, the first and second gears 138 and 140 on the stationary shaft 92 and the gear 142 on the stationary shaft 144 are assumed, for the reason that will be understood as the description proceeds, to be selected so that the gear 142 on the stationary shaft 144 makes a one eighth turn about the center axis of the shaft 144 each time the cam shaft 128 makes a full turn about its center axis.

The weft selector signal supply means 30 further comprises three sets of pattern card arrangements which are provided in conjunction with the previously described lobular second, third and fourth cams 48b, 48c and 48d, respectively, of the cam assembly 22, although only one of the pattern card arrangements is illustrated in FIG. 1. The shown pattern card arrangement is assumed to be associated with the cam actuating unit for the second cam 48b of the cam assembly 22 and comprises a sprocket wheel 146b which is rotatable on the stationary shaft 144 carrying the above mentioned gear 142 and an endless chain 148b which has one turning end on the sprocket wheel 146b. The sprocket wheel 146b is assumed to have eight teeth and is, thus, rotated about the center axis of the stationary shaft 144 through an angle corresponding to the pitch between neighboring two of the teeth each time the previously mentioned drive shaft 126 makes a full turn about its center axis. The sprocket wheel 146b has a projection or peg 150b mounted on predetermined one of the teeth thereof. The respective sprocket wheels of the pattern card arrangements associated with the individual lobular cams 48*b*, 48*c* and 48*d* are all securely connected to the gear 142 on the stationary shaft 144 though not shown in the drawings and are, thus, bodily rotatable with the gear 142 about the center axis of the shaft 144.

The previously mentioned locking arms 32 is adapted to transmit the motions of the individual pattern card arrangements to the previously described cam actuating units associated with the lobular second, third and fourth cams 48*b*, 48*c* and 48*d* of the cam assembly 22 and thus consists of three locking units which are provided in association with the individual cam actuating units, respectively. Such locking units are constructed and arranged similarly to each other and, for this reason, description will be herein made mainly in respect of the contruction and arrangement of the locking unit for the cam actuating unit associated with the second cam 48*b*, viz., the locking unit provided in conjunction with the rocker 90*b*.

The locking units associated with the rockers 90*b*, 90*c* and 90*d* comprises generally λ-shaped rocking members 152*b*, 152*c* and 152*d*, respectively, which are commonly mounted on a horizontal stationary shaft 154 having a center axis substantially parallel with the respective center axes of the stationary shafts 92 and 144. The individual rocking members 152*b*, 152*c* and 152*d* are spaced apart from each other in parallel with the center axis of the shaft 154 as will be clearly seen in FIG. 2 and are aligned with the sprocket wheels of the pattern card arrangements associated with the second, third and fourth cams 48*b*, 48*c* and 48*d*, respectively, of the cam assembly 22 though not seen in the drawings. The rocking member 152*b* associated with the pattern card arrangement for the second cam 48*b* comprises, as shown in FIG. 1, first, second and third arm portions 156*b*, 158*b* and 160*b* which project from the center portion of the rocking member 152*b* and which are angularly spaced apart from each other about the center portion. The first arm portion 156*b* extends generally downwardly from the center portion of the rocking member 152*d* and is formed with a projection 162*b* which is located and movable in the vicinity of the sprocket wheel 146*b* and which is thus engageable with the projection or peg 150*b* on the sprocket wheel 146*b* of the associated pattern card arrangement. The second arm portion 158*b* extends generally upwardly from the center portion of the rocking member 152*b*, viz., in a direction opposite to the first arm portion 156*b*. The third arm portion 160*b* extends substantially horizontally from the center portion of the rocking member 152*b* and has its leading end located in the vicinity of the upper first arm portion 94*b* of the rocker 90*b*. As will be understood as the description proceeds, the rocking member 152*b* is rotatable about the center axis of the stationary shaft 154 between a first angular position having the projection 162*b* of its first arm portion 156*b* located to be ready to engage or ride on the peg 150*b* on the sprocket wheel 146*b* as shown in FIG. 1 and a second angular position engaged by and riding on the peg 150*b* and thus moved away from the shaft 144 carrying the sprocket wheel 146*b*. The rocking member 152*b* is urged to turn clockwise in FIG. 1 or toward the above mentioned first angular position thereof about the center axis of the shaft 154 by suitable biasing means such as a preloaded helical tension spring 164*b* which is anchored at one end to the second arm portion 158*b* by a spring retaining pin 166*b* and at the other end to an elongated spring retaining pin 168 which is, though not shown in the drawings, connected between the vertical wall members 42 and 42' of the support structure 40 shown in FIG. 2. The rocking members 152*c* and 152*d* associated with the third and fourth cams 48*c* and 48*d* are shaped similarly to the above described rocking member 152*b*, each comprising first, second and third arm portions similar to the arm portions 156*b*, 158*b* and 160*b*, respectively, of the rocking member 152*b* and a projection formed on the first arm portion similarly to the projection 162*b* of the first arm portion 156*b* of the rocking member 152*b*, though not shown in the drawings. Each of the rocking members 152*c* and 152*d* is also rotatable about the center axis of the stationary shaft 154 between first and second angular positions which are respectively similar to those of the rocking member 152*d*. Similarly to the rocking member 152*b*, the rocking members 152*c* and 152*d* are urged to turn toward the second angular positions thereof by means of preloaded helical tension springs 164*c* and 164*d*, respectively, which are similarly arranged to the above described spring 164*b* connected to the rocking member 152*b*. The springs 164*c* and 164*d* are anchored each at one end to the respective second arm portions of the rocking members 152*c* and 152*d* by spring retaining pins 166*c* and 166*d*, respectively, and at the other ends to the previously mentioned pin 168 connected between the vertical wall members 42 and 42' of the support structure 40 as will be seen from FIG. 2.

The rotational position of each of the rocking members 152*b*, 152*c* and 152*d* in conditions having the projections of their respective first arm portions in contact with the teeth or the chains of the associated pattern card arrangements is herein referred to as a first angular position of the rocking member about the center axis of the stationary shaft 154. Likewise, the rotational position of each of the rocking members 152*b*, 152*c* and 152*d* in conditions having the projections of their respective first arm portions in contact with the projections or pegs on the sprocket wheels of the associated pattern card arrangements is herein referred to as a second angular position of the rocking member about the center axis of the shaft 154. The first and second angular positions of each rocking member are the clockwise and counter-clockwise limit angular positions, respectively, of the rocking member. The peg of each pattern card arrangement being assumed to be mounted on one of the eight teeth of the sprocket wheel as previously mentioned, each of the rocking members 152*b*, 152*c* and 152*d* is rotated into the second angular position thereof every time the sprocket wheel is driven to turn by eight pitches about the center axis of the shaft 144 or, in other words, the drive shaft 126 and accordingly each of the eccentric cams 134*b*, 134*c* and 134*d* make eight turns about the center axes of the shafts 126 and 128, respectively. Each rocking member is biased to turn toward the first angular position thereof by means of each of the tension springs 164*b*, 164*c* and 164*d*.

The stationary shaft 154 thus carrying the rocking members 152*b*, 152*c*, and 152*d* has further mounted thereon clamping members 170*b*, 170*c* and 170*d* which are rotatable on the shaft 154 about the center axis of the shaft 154. As illustrated in FIG. 1, the clamping member 170*b* associated with the second cam 48*b* has a latch portion 172*b* formed with a guide surface 174*b* slanting from the leading end of the clamping member 170*b* and terminating at an edge portion 176*b* which is substantially parallel with the center axis of the stationary shaft 154 and which is engageable in a surface-to-surface fashion with the previously mentioned surface portion 120b of the land 118b on the rocket 90b depending upon the relative angular positions of the clamping member 170b and and the rocker 90b about the center axes of the stationary shafts 92 and 154, respectively. The clamping member 170b is urged to turn about the center axis of the shaft 154 counter-clockwise in FIG. 1 relative to the associated rocking member 152b by suitable biasing means such as a preloaded helical tension spring 178b which is anchored at one end to the leading end of the third arm portion 160b of the rocking member 152b by a spring retaining pin 180b and at the other end to the clamping member 170b by a spring retaining pin 182d. When the clamping member 170b has its edge portion 176b held in surface-to-surface contact with the surface portion 120b of the land 118b on the rocker 90b as shown in FIG. 1 with the upper first arm portion 94b of the rocker 90b urged away from the stationary shaft 154 by the force of the tension spring 98b, the edge portion 176b of the clamping member 170b urged to turn counter-clockwise in FIG. 1 by the above mentioned tension spring 178b tends to slide on the surface portion 120b of the land 118b away from the shaft 92. A frictional force is thus produced between the edge portion 176b of the clamping member 170b and the surface portion 120b of the land 118b and resists the sliding movement of the clamping member 170b on the land 118b. In order that the clamping member 170b be held in engagement with the land 118b under such conditions, it is important that the tension spring 178 responsible for such a tendency be selected so that the force of the spring 178 is smaller than the frictional force thus produced between the edge portion 176b of the clamping member 170b and the surface portion 120b of the land 118b on the rocker 90b. The clamping members 170c and 170d associated with the third and fourth cams 48c and 48d, respectively, are configured similarly to the above described clamping member 170b and are engageable with the lands 118c and 118d on the rockers 90c and 90d, respectively, depending upon the relative angular positions of each of the rockers 90c and 90d and each of the clamping members 170c and 170d about the center axes of the stationary shafts 92 and 154, respectively. The clamping members 170c and 170d are connected to the rocking members 152c and 152d, respectively, by biasing means which are arranged similarly to the above described biasing means including the tension spring 178d connected between the clamping member 170b and the rocking member 152b.

The clamping member 170b is further formed with a projection 184b extending approximately in parallel with the second arm portion 158b of the associated rocking member 152b. The projection 184b of the clamping member 170b is engageable with an adjustable stop member 186b mounted on the previously mentioned cross member 44 of the support structure 40 (FIG. 2) and with a stop member 188b which is fixedly mounted on the second arm portion 158b of the rocking member 152b. The stop member 186b on the cross member 44 of the support structure 40 is located to limit the rotation of the clamping member 170b clockwise in FIG. 1 about the center axis of the shaft 154 and to prevent the clamping member 170b from being rotated clockwise in FIG. 1 beyond the angular position capable of receiving the surface portion 120b of the land 118b on its edge portion 176b as shown in FIG. 1. When the projection 184b of the clamping member 170b is thus held in abutting engagement with the stop member 186b, the clamping member 170b has about the center axis of the shaft 154 an angular position having its edge portion receiving or ready to receive the surface portion 120b of the land 118b on the rocker 90b. Such an angular position of the clamping member 170b is herein referred to as the lockable angular position of the clamping member 170b.

When the clamping member 170b is held in the lockable angular position and at the same time the land 118b on the rocker 90b has its surface portion 120b received on the edge portion 176b of the clamping member 170b by the force of the tension spring 98b, the rocker 90b assumes about the center axis of the stationary shaft 92a predetermined angular position which is close to or slightly turned clockwise in FIG. 1 from the previously mentioned first limit angular position thereof. Such a predetermined angular position is herein referred to as an allowance angular position of the rocker 90b about the center axis of the stationary shaft 92. The angular position of the rocker 90b as indicated by the full lines in FIG. 1 is, thus, strictly the allowance angular position of the rocker 90b, which is accordingly rotatable about the center axis of the shaft 154 slightly counter-clockwise in FIG. 1 from the allowance angular position indicated by the full lines to the first limit angular position when the clamping member 170b is in the lockable angular position thereof and has its edge portion 176b located to be engageable with the land 118b on the rocker 90b. It is apparent that each of the remaining rockers 90c and 90d also has its allowance angular position similar to the allowance angular position of the rocker 90b.

The stop member 188b on the second arm portion 158b of the rocking member 152b is adapted to limit the relative rotation between the rocking member 152b and the associated clamping member 170b about the center axis of the stationary shaft 154, viz., the rotation of the rocking member 152b clockwise in FIG. 1 relative to the clamping member 170b and the rotation of the clamping member 170b counter-clockwise in FIG. 1 relative to the rocking member 152b. When the clamping member 170b is in the above mentioned lockable angular position having one face of the projection 184b in contact with the stop member 186b, the stop member 188b on the second arm portion 158b of the rocking member 152b is forced against the other face of the projection 184b of the clamping member 170b by the forces of the tension aprings 164b and 178b, mainly by the force of the tension spring 164b when the rocking member 152b is allowed to be held in the previously mentioned first angular position thereof with the projection 162b of the first arm portion 156b of the rocking member 152b disengaged from the peg 150b on the sprocket wheel 146b, as shown in FIG. 1.

On the cross member 44 of the support structure 40 are further mounted adjustable stop members 186c and 186d which are similar to the above described stop member 186b. The stop members 186c and 186d are located so that the clamping members 170c and 170d associated with the third and fourth cams 48c and 48d are respectively engageable therewith. Thus, the clamping members 170c and 170d also have their lockable angular positions having their projections (which are the counterparts of the projection 184b of the clamping member 170b) in abutting engagement with the stop members 186c and 186d, respectively. Each of the rocking members 152c and 152d associated with these clamping members 170c and 170d, respectively, has also mounted on its second arm portion a stop member which is similar to the stop member 188b on the second arm portion 158b of the rocking member 152b, though not illustrated in the drawings.

Description will be hereinafter made regarding the operation of the apparatus thus constructed and arranged.

In operation, the drive shaft 126 is driven for rotation about its center axis at a constant velocity which is proportional to the velocities at which the other driven members and structures of the weaving loom are driven. The rotation of the drive shaft 126 is transmitted through the gear 130 on the shaft 126 to the first gear 132 on the cam shaft 128 and from the gear 132 to each of the eccentric cams 134b, 134c and 134d on the cam shaft 128. Each of the eccentric cams 134b, 134c and 134d is, thus, driven to make a full turn about the center axis of the cam shaft 128 in each cycle of operation of the loom. If, under these conditions, engagement is established between, for example, the land 118b on the rocker 90b and the edge portion 176b of the associated clamping member 170b as shown in FIG. 1, the rocker 90b is held in the previously mentioned allowance angular position about the center axis of the stationary shaft 92 and is, thus, caused to slightly oscillate between the allowance angular position and the first limit angular positions about the center axis of the shaft 92 as the associated eccentric cam 134b is rotated about the center axis of the cam shaft 128 and is cyclically brought into rolling contact at the vertex of its higher lobe portion with the cam follower roller 122b on the lower second arm portion 96b of the rocker 90b.

The driving torque transmitted to the first gear 132 on the cam shaft 128 is transmitted through the second gear 134 on the cam shaft 128 and the first and second gears 138 and 140 on the atationary shaft 92 to the gear 142 on the stationary shaft 144 carrying the pattern card arrangements and drives the individual sprocket wheels of the pattern card arrangements. Each of the sprocket wheels, such as for example the sprocket wheel 146b shown in FIG. 1 is thus driven to make a one-eighth turn about the center axis of the shaft 144 so that the individual elements of the chain 148b running on the sprocket wheel 146b are moved one after another in the vicinity of the projection 162b of the first arm portion 156b of the rocking member 152b. If, under these conditions, the peg 150b on the sprocket wheel 146b is located off the position engageable with the projection 162b of the rocking member 152b, the rocking member 152b is maintained in the previously mentioned first angular position thereof about the center axis of the stationary shaft 154 as illustrated in FIG. 1 and allows the associated clamping member 170b to be held in the lockable angular position thereof. As the sprocket wheel 146b is further rotated about the center axis of the shaft 144 and the peg 150b thereon is brough into abutting engagement with the projection 162b of the first arm portion 156b of the rocking member 152b, the projection 162b rides on the peg 150b and is thus moved away from the shaft 144 carrying the sprocket wheel 146b so that the rocking member 152b as a whole is driven to turn about the center axis of the shaft 154 counter-clockwise in FIG. 1 against the force of the tension spring 164b and reaches the previously mentioned second angular position thereof. The tension spring 178b connected between the rocking member 152b and the associated clamping member 170b is therefore urged to extend lengthwise and urges the clamping member 170b to turn counterclockwise in FIG. 1 about the center axis of the shaft 154 out of the lockable angular position thereof. Because, however, of the fact that the rocker 90b associated with the clamping member 170b is urged to turn about the center axis of the shaft 92 clockwise in FIG. 1, viz., in a direction having the surface portion 120b of the land 118b forced against the edge portion 176b of the clamping member 170b by means of the tension spring 98b, the engagement between the land 118b on the rocker 90b and the edge portion 176b of the clamping member 170b is maintained due to the frictional force established between the surface portion 120b of the land 118b and the edge portion 176b during a period of time for which the eccentric cam 134b associated with the rocker 90b is disengaged from the cam follower roller 122b on the rocker 90b and accordingly the rocker 90b is maintained in the previously mentioned allowance angular position thereof. When the eccentric cam 134b is in rolling contact at the vertex of its higher lobe portion with the cam follower roller 122b on the rocker 90b, the cam follower roller 122b is slightly raised over the cam shaft 128 and causes the rocker 90b to slightly turn about the center axis of the shaft 92 counter-clockwise in FIG. 1 from the allowance angular position into the first limit angular position of the rocker 90b against the force of the tension spring 98b. The land 118b on the upper first arm portion 94b of the rocker 90b is slightly moved toward the shaft 154 carrying the clamping member 170b and reduces the frictional force between the surface portion 120b of the land 118b and the edge portion 176b of the clamping member 170b. The force of the tension spring 178b connected between the rocking member 152b and the clamping member 170b now overcomes the frictional force between the land 118b and the edge portion 176b and causes the clamping member 170b to turn about the center axis of the shaft 154 counter-clockwise in FIG. 1 out of the lockable angular position thereof, allowing the land 118b to be disengaged from the edge portion 176b. The rocker 90b is thus released from the clamping member 170b and becomes freely rockable about the center axis of the stationary shaft 92. The cam follower roller 122b on the lower second arm portion 96b of the rocker 90b is held in rolling contact with the eccentric cam 134b on the cam shaft 128 by the force of the tension spring 98b so that the rocker 90b is driven to oscillate between the first and second limit angular positions thereof about the center axis of the shaft 92 as the eccentric cam 134b rolls on the cam follower roller 122b. The rocker 90b makes one oscillatory motion per turn of the drive shaft 126. When the rocker 90b is thus turned clockwise in FIG. 1 about the center axis of the shaft 92 by the force of the tension spring 98b, the cam actuating member 104b pivotally mounted on the upper first arm portion 94b of the rocker 90b is moved downwardly slantwise to the cam shaft 46 of the cam assembly 22. As the cam actuating member 104b is thus moved slantwise downwardly, the hook portion 108b of the cam actuating member 104b has its guide surface 110b held in sliding contact with one of the pins 54b on the lobular second cam 48b by the force of the tension spring 114b urging the cam actuating member 104b to turn counterclockwise on the rocker 90b. When the rocker 90b reaches the second limit angular position with the cam follower roller 122b riding on the vertex of the lower lobe portion of the eccentric cam 134b as indicated by phantom lines in FIG. 1, the cam actuating member 104b assumes the lowermost position thereof and has the above mentioned one of the pins 54b captured in the notch 122b in the hook portion 108b of the member 104b as is also indicated by phantom lines in FIG. 1. As the eccentric cam 134b is further rotated about the center axis of the cam shaft 128, the rocker 90b is driven to turn about the center axis of the shaft 92 counter-clockwise in FIG. 1 from the second limit angular position thereof against the force of the tension spring 98b and moves the cam actuating member 104b slantwise upwardly from the lowermost position thereof with the above mentioned one of the pins 54b held in the notch 112b in the hook portion 108b thereof. The lobular second cam 48b is thus driven to rotate clockwise in FIG. 1 about the center axis of the cam shaft 46 independently of the remaining cams 48a, 48c and 48d. When the rocker 90b reaches the first limit angular position with the cam follower roller 122b riding on the vertex of the higher lobe portion of the eccentric cam 134b, the cam actuating member 104b restores the uppermost position thereof approximating the position indicated by full lines in FIG. 1, and the lobular second cam 48b ceases rotation about the center axis of the cam shaft 46. The cam 48b is in this fashion driven to make a one-sixth turn about the axis of the cam shaft 46 when the drive shaft 126 makes a full turn about its axis and accordingly the rocker 90b makes a single oscillatory motion about the center axis of the stationary shaft 92.

When the rocker 90b is thus making an oscillatory motion about the center axis of the shaft 92, the sprocket wheel 146b of the associated pattern card arrangement makes another one-eighth turn about the center axis of the shaft 144 so that the peg 150b is moved past the projection 162b of the first arm portion 156b of the rocking member 152b. This causes the rocking member 152b to turn clockwise in FIG. 1 about the center axis of the stationary shaft 154 by the force of the tension spring 164b so that the associated clamping member 170b having its projection 184b forced against the stop member 188b on the rocking member 152b by the tension spring 178b is turned together with the rocking member 152b clockwise in FIG. 1 about the center axis of the shaft 154 until the projection 184b of the clamping member 170b is brought into abutting engagement with the stop member 186b on the cross member 44 of the support structure 40 (FIG. 2). The clamping member 170b now restores the lockable angular position thereof and has its edge portion 176b located in the path of the surface portion 120b of the land 118b on the rocker 90b. When the rocker 90b is rotated counter-clockwise in FIG. 1 back from the second limit angular position as above described, the land 118b is in sliding contact at the end of its surface portion 120b with the guide surface 174b of the latch portion 172b of the clamping member 170b held in the lockable angular position until the rocker 90b resumes the first limit angular position and the surface portion 120b of the land 118b is moved past the edge portion 176b. When the eccentric cam 134b is rotated to have the vertex of its higher lobe portion moved out of rolling contact with the cam follower roller 122b on the rocker 90b immediately after the rocker 90b is thus rotated into the first limit angular position thereof, the rocker 90b is caused to slightly turn clockwise in FIG. 1 by the force of the tension spring 98b until the surface portion 120b of the land 118b on the rocker 90b is received on the edge portion 176b of the clamping member 170b. The rocker 90b now restores the previously mentioned allowance angular position thereof and is thereafter caused to slightly oscillate between the allowance angular position and the first limit angular position thereof as the eccentric cam 134b rolls on the cam follower roller 122b on the rocker 90b.

Each of the lobular second, third and fourth cams 48b, 48c and 48d is, in this fashion, driven to turn through 60° about the center axis of the cam shaft 46 independently of the other cams every time the sprocket wheel of the associated pattern card arrangement makes a full turn about the center axis of the shaft 144, viz., per eight turns of the drive shaft 126. When each of the cams 48b, 48c and 48d makes a one-sixth turn about the center axis of the cam shaft 46, the cam is rotated out of an angular position having the vertex of one of its cam lobe portions 50b, 50c or 50d aligned with the associated one of the cam follower rollers 64b, 64c and 64d into an angular position having the bottom portion 52b, 52c or 52d posterior to the above mentioned one of the cam lobe portions aligned with the associated cam follower roller or out of an angular position having one of its bottom portions 52b, 52c or 52d aligned with the associated one of the cam follower rollers 64b, 64c and 64d into an angular position having the cam lobe portion posterior to the above mentioned one of the bottom portions. The relative angular positions of the individual lobular cams 48b, 48c and 48d are varied in accordance with a predetermined schedule which is dictated by the locations of the respective pegs on the sprocket wheels of the pattern card arrangements associated with the cams. The cam assembly 22 as a whole is, thus, actuated into various operative conditions including first, second, third and fourth operative conditions which are diagrammatically illustrated in FIGS. 3A, 4A, 5A and 6A, respectively.

Figure 3A:
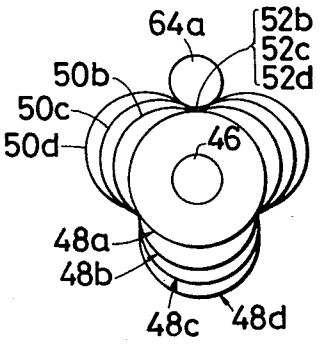
Figure 3B:
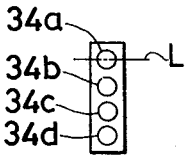

In the first operative condition of the cam assembly 22, as shown in FIG. 3A, all the lobular cams 48b, 48c and 48d are in phase with each other and have their bottom portions 52b, 52c and 52d aligned with each other in parallel with the center axis of the cam shaft 46 and contacted by the second, third and fourth cam follower rollers 64b, 64c and 64d, respectively. When the cams 48b, 48c and 48d and the associated cam follower rollers 64b, 64c and 64d are held in these positions, the cam follower roller 64a assocated with the circular first cam 48a is in contact with the outer peripheral surface of the cam 48a so that the parallel arms 58 and 58' supporting the cam follower rollers 64a, 64b, 64c and 64d assume the previously mentioned first angular positions about the center axis of the rotatable shaft 56 with which the arms 58 and 58' are rotatable. With the parallel arms 58 and 58' held in the first angular positions thereof as indicated by full lines in FIG. 1, the bell crank lever 74 connected to the shaft 56 by the control arm 72 and the connecting rod 78 assumes the clockwise extreme rotational position or the previously mentioned first angular position thereof about the center axis of the stationary shaft 76 and has the leading end of its second arm portion 76b held in the lowermost position thereof over the carrier 36 of the weft insertion unit 20, as also indicated by full lines in FIG. 1. The carrier 36 is therefore held in the lowermost vertical position thereof having the first weft shooting nozzle 34a located to have its center axis flush with the warp line L, as seen in FIG. 1 and diagramatically illustrated in FIG. 3B so that the pick of the weft yarn (not shown)

which has been detained in the first weft shooting nozzle 34*a* is shot into the weaving shed S between the webs W and W' of warp yarns by a jet stream of fluid spurting from the nozzle 34*a*. Upon completion of the above described weaving cycle, the healds H and H' are driven to lower and raise the webs W and W', respectively, of warp yarns from the shown positions and form a new shed therebetween. Another pick of weft yarn is then inserted into the new shed from the first weft shooting nozzle 34*a*. When the second weaving cycle is complete, the healds H and H' are driven for a second time and raise and lower the webs W and W', respectively, of warp yarns into the shown positions. Upon termination of the consecutive two cycles of operation, one or more of the lobular cams 48*b*, 48*c* and 48*d* are rotated about the center axis of the cam shaft 46 in accordance with the schedule dictated by the locations of the pegs on the sprocket wheels in the individual pattern card arrangements. If, in this instance, the lobular second cam 48*b* is driven to make a one-sixth turn about the center axis of the cam shaft 46 from the above described conditions, the cam assembly 22 establishes the previously mentioned second operative condition which is diagrammatically illustrated in FIG. 4A.

Figure 4A:
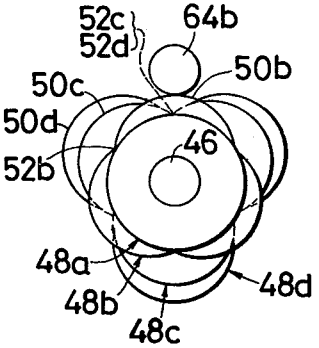
Figure 4B:
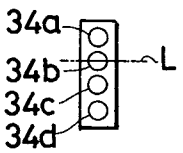

In the second operative condition of the cam assembly 22, the lobular second cam 48*b* has one of its cam lobe portions 50*b* contacted by the associated cam follower roller 64*b* with each of the remaining lobular cams 48*c* and 48*d* maintained in the angular position having one of its bottom portions 52*c* or 52*d* located in alignment with the associated cam follower 64*c* or 64*d* as seen in FIG. 4A. The cam follower roller 64*b* associated with the second cam 48*b* and accordingly the cam follower rollers 64*a*, 64*c* and 64*d* associated with the first, third and fourth cams 48*a*, 48*c* and 48*d*, respectively, are all raised over the cam shaft 46 from their positions obtained under the first operative condition of the cam assembly 22 so that the parallel arms 58 and 58' supporting the common shaft 62 of the cam follower rollers 64*a*, 64*b*, 64*c* and 64*d* are turned counter-clockwise in FIG. 1 and reach the previously mentioned second angular positions thereof about the center axis of the rotatable shaft 56, though not illustrated in the drawings. As a consequence, the bell crank lever 74 is rotated counterclockwise in FIG. 1 from its first angular position about the center axis of the stationary shaft 76 and assumes the previously mentioned second angular position thereof, raising the carrier 36 of the weft insertion unit 20 from the lowermost position thereof into a vertical position having the second weft shooting nozzle 34*b* located to have its center axis flush with the warp line L as diagrammatically illustrated in FIG. 4B. The weft yarn which has been detained in the second weft shooting nozzle 34*b* is then shot into the weaving shed S in consecutive two steps in the same manner as described in connection with the first weft shooting nozzle 34*a*.

Figure 5A:
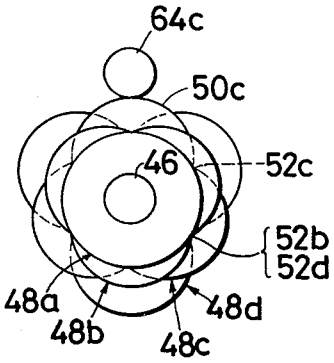
Figure 5B:
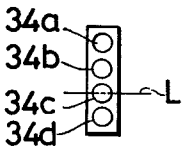

In the third operative condition of the cam assembly 22, the lobular third cam 48*c* is contacted by the associated cam follower roller 64*c* with the lobular fourth cam 48*d* held in an angular position having one of its bottom portions 52*d* located in alignment with the associated cam follower roller 64*d*, as diagrammatically illustrated in FIG. 5A. In FIG. 5A, the lobular second cam 48*b* is shown to be held in an angular position having one of its bottom portions 52*b* aligned with the associated cam follower roller 64*b* (not shown in FIG. 5A) but it is apparent that the third operative condition of the cam assembly 22 is achieved with out respect to the angular position of the second cam 48*b* because the cam lobe portions 50*b* of the second cam 48*b* are smaller in radius than the cam lobe portions 50*c* of the third cam 48*c*. When the cam follower roller 64*c* is in contact with one of the cam lobe portions 50*c* of the third cam 48*c*, the cam follower rollers 64*a*, 64*b*, 64*c* and 64*d* on the shaft 62 are further raised over the cam shaft 46 from their positions obtained under the second operative condition of the cam assembly 22 and cause the parallel arms 58 and 58' and accordingly the bell crank lever 74 to turn further counter-clockwise in FIG. 1 about the center axes of the shafts 56 and 76, respectively, from their respective second angular positions. The parallel arms 58 and 58' and the bell crank lever 74 are thus moved into the previously mentioned third angular positions respectively thereof with the result that the carrier 36 of the weft insertion unit 20 is further moved upwardly into a vertical position having the third weft shooting nozzle 34*c* located to have its center axis flush with the warp line L as diagrammatically shown in FIG. 5B. The weft yarn which has been detained in the third weft shooting nozzle 34*c* is now ready to be shot into the weaving shed S.

Figure 6A:
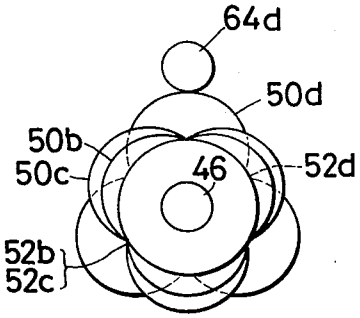
Figure 6B:
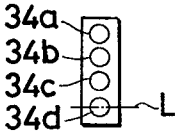

When the lobular fourth cam 48*d* is moved into an angular position having one of its cam lobe portions 50*d* contacted by the associated cam follower roller 64*d*, the fourth operative condition of the cam assembly 22 is established as disgrammatically illustrated in FIG. 6A. In FIG. 6A, each of the second and third cams 48*b* and 48*c* is shown to have an angular position having one of its bottom portions 52*b* or 52*c* aligned with the associated cam follower roller 64*b* or 64*c* (not shown in FIG. 6A), the fourth operative condition of the cam assembly 22 is achieved without respect to the angular positions of the second and third cams 48*b* and 48*d* because both of the second and third cams 48*b* and 48*c* are smaller in radius than the fourth cam 48*d*. When the cam assembly 22 is in the fourth operative condition thereof, the cam follower rollers 64*a*, 64*b*, 64*c* and 64*d* on the shaft 62 are still further raised over the cam shaft 46 from their positions obtained under the third operative condition of the cam assembly 22 and cause the parallel arms 58 and 58' and accordingly the bell crank lever 74 to turn still further counter-clockwise in FIG. 1 about the center axes of the shafts 56 and 76, respectively, from their respective third angular positions. The parallel arms 58 and 58' and the bell crank lever 74 are thus moved into their counter-clockwise extreme rotational positions or the previously mentioned fourth angular positions respectively thereof as indicated by phantom lines in FIG. 1 so that the carrier 36 of the weft insertion unit 20 is raised to the uppermost position thereof having the fourth weft shooting nozzle 34*d* located to have its center axis flush with the warp line L, as diagrammatically illustrated in FIG. 6B. The fourth weft shooting nozzle 34*d* is now conditioned to insert the weft yarn into the weaving shed S.

The carrier 36 of the weft insertion unit 20 is in this fashion moved between the four different vertical positions in accordance with the signals delivered from the pattern card arrangements associated with the four weft shooting nozzle 34*a*, 34*b*, 34*c*, and 34*d* so that a weft yarn selected from the weft yarns detained in the individual nozzles is shot into the weaving shed during each cycle of operation of the loom.

Figure 7:
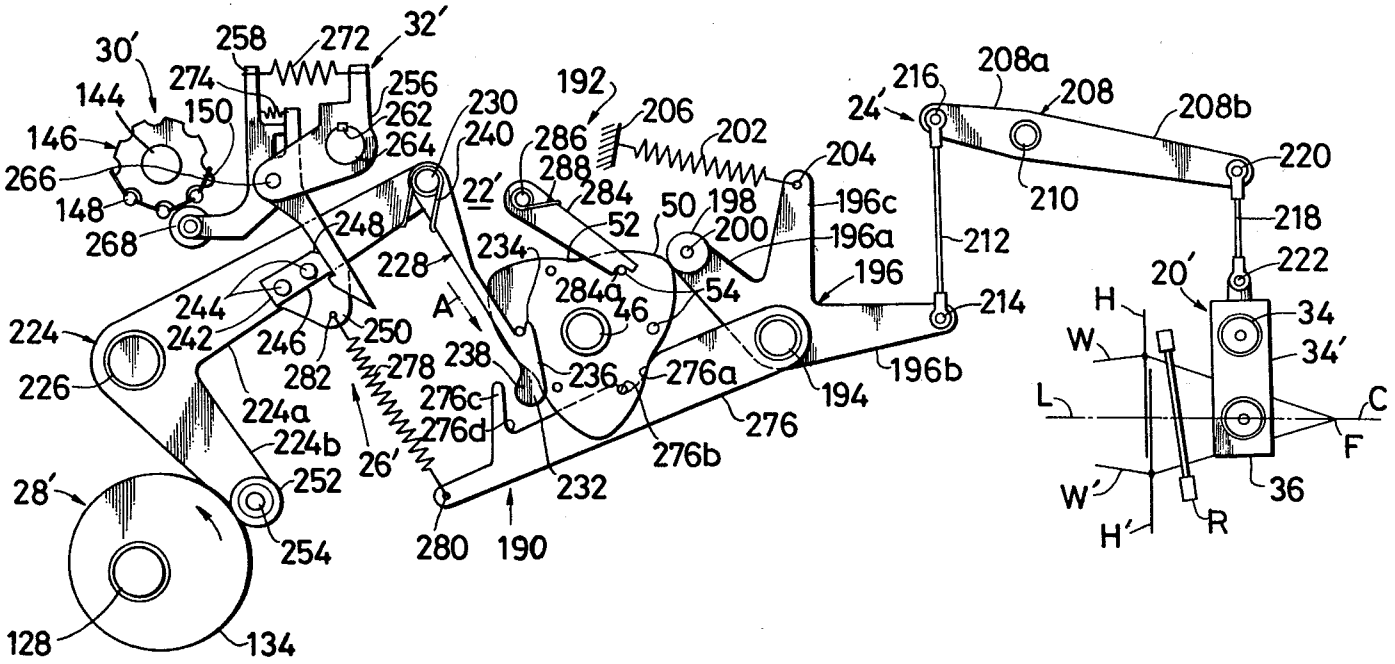
FIG. 7 is a side elevational view of a second preferred embodiment of the apparatus according to the present invention.

FIG. 7 illustrates another preferred embodiment of the apparatus according to the present invention. While the embodiment which has been described is capable of dealing with up to four weft yarns, the embodiment illustrated in FIG. 7 is adapted to selectively use two weft yarns having different natures, particularly colors.

The embodiment of FIG. 7 largely comprises first and second cam retaining means 190 and 192 in addition to a weft insertion unit 20', a weft selector cam assembly 22', a link mechanism 24', cam actuating means 26', intermittent-motion drive means 28', a pattern card arrangement 30' serving as program-controlled weft selector signal supply means, and locking means 32' which are essentially similar to their respective counterparts in the embodiment of FIGS. 1 and 2.

The weft insertion unit 20' is located in the vicinity of the weaving shed S and comprises first and second weft shooting nozzles 34 and 34' jointly mounted on a nozzle carrier 36'. The carrier 36' is vertically movable between a lower first position having the first nozzle 34 aligned with the weaving shed S and an upper second position having the second nozzle 34' aligned with the weaving shed S as shown. The weft insertion unit 20' thus arranged operates essentially similarly to its counter-part in the embodiment of FIGS. 1 and 2 and, thus, description regarding the operation thereof may not be herein incorporated.

On the other hand, the weft selector cam assembly 22' comprises a horizontal cam shaft 46 and a lobular cam 48 rotatable on the cam shaft 46. The lobular cam 48 is configured similarly to each of the lobular cams **48*b*, 48*c* and 48*d* incorporated in the cam assembly 20 of the previously described embodiment and is, thus, formed with three arcuate cam lobe portions 50 and three bottom portions 52 between the lobular portions 50. The lobular cam 48 is provided with six pins 54 which are arranged also similarly to their counterparts in the previously described cam assembly 22**.

The link mechanism 24' provided between the above described weft insertion unit 20' and cam assembly 22' comprises a horizontal stationary shaft 194 having a center axis substantially parallel with the center axis of the above mentioned cam shaft 46. A bell crank lever 196 has an intermediate fulcrum portion rotatably mounted on the stationary shaft 194 and has first, second and third arm portions **196*a*, 196*b* and 196*c* extending from the fulcrum portion and angularly spaced apart from each other about the center axis of the shaft 194. The first arm portion 196*a* of the bell crank lever 196 has mounted at its leading end a cam follower roller 198 which is rotatable about the center axis of a pin 200 mounted on the arm portion 196*a* and having a center axis substantially parallel with the respective center axes of the shafts 46 and 194. The cam follower roller 198 is engageable with the cam 48 or, more specifically, rollable on one of the cam lobe portions 50 or one of the bottom portions 52 of the cam 48 depending upon the angular position of the cam 48 with respect to the bell crank lever 196 as will be described in more detail. The cam follower roller 198 is forced against the cam surface of the cam 48 by suitable biasing means operative to urge the bell crank lever 196 to turn counter-clockwise in FIG. 7, such biasing means being shown comprising a preloaded helical tension spring 202 which is anchored at one end to the third arm portion 196*c* of the bell crank lever 196 by a pin 204 and at the other end to a suitable stationary member or structure 206 which may be part of the loom construction or of the previously mentioned support structure 40 of the embodiment illustrated in FIG. 2. When the cam 48 is rotated about the center axis of the cam shaft 46, the cam follower roller 200 on the first arm portion 196*a* of the bell crank lever 196 is alternately raised and lowered over the cam shaft 46 and consequently the bell crank lever 196 is oscillated between clockwise and counter-clockwise extreme rotational positions, respectively, in FIG. 7 about the center axis of the shaft 194 as the cam follower roller 200 is alternately brought into rolling contact with each of the cam lobe portions 50 and each of the bottom portions 52 of the cam 48. The counter-clockwise and clockwise extreme rotational positions of the bell crank lever 196 are herein referred to as first and second angular positions, respectively, of the bell crnak lever 196 about the center axis of the stationary shaft 194. As the bell crank lever 196 is rotated about the center axis of the shaft 194 toward the first and second angular positions, the second arm portion 196*b*** thereof has its leading end moved upwardly and downwardly, respectively.

The link mechanism 24' further comprises a rocker 208 having an intermediate fulcrum portion rotatably mounted on a horizontal stationary shaft 210 having a center sxis substantially parallel with the center axis of the shaft 194 carrying the bell crank lever 196. The rocker 208 has first and second arm portions **208*a* and 208*b* extending generally horizontally in opposite directions from the intermediate fulcrum portion of the rocker 208 and having respective leading ends located over the leading end of the second arm portion 196*b* of the bell crank lever 208 and the nozzle carrier 36' of the weft insertion unit 20', respectively, as shown. A generally vertical connecting rod 212 is pivotally connected at one end to the leading end of the second arm portion 196*b* of the bell crank lever 196 by a pivotal pin 214 and at the other end to the leading end of the first arm portion 208*a* of the rocker 208 by a pivotal pin 216. Likewise, a generally vertical connecting rod 218 is pivotally connected at one end to the leading end of the second arm portion 208*b* of the rocker 208 by a pivotal pin 220 and at the other end to the nozzle carrier 36' of the weft insertion unit 20' by a pivotal pin 222. When, thus, the bell crank lever 196 is rotated into the previously mentioned first and second angular positions, viz., the counter-clockwise and clockwise extreme rotational positions thereof in FIG. 7 about the center axis of the shaft 194 and has the leading end of its second arm portion 196*b* moved to the uppermost and lowermost positions, the rocker 208 is driven to turn clockwise and counter-clockwise, respectively, in FIG. 7 about the center axis of the shaft 210 so that the nozzle carrier 36' is moved into the lower first and upper second positions, respectively. The first and second weft shooting nozzles 34 and 34' are thus moved into the positions aligned with the weaving shed S when the bell crank lever 196 is moved into the first and second angular positions, respectively, thereof about the center axis of the shaft 194. essentially similarly to each of the cam actuating units in the previously described embodiments of FIGS. 1 and 2 and comprises a bell crank lever 224 having an intermediate fulcrum portion rotatably mounted on a horizontal stationary shaft 226 having a center axis which is substantially parallel with the center axis of the cam shaft 46. The bell crank lever 224 has first and second arm portions 224*a* and 224*b* extending generally upwardly and downwardly from the fulcrum portion of the bell crank lever and angularly spaced apart from each other about the center axis of the shaft 226. The bell crank lever 224 has supported at the leading end of its first arm portion 226***a* an elongated cam actuating member 228 by a pivotal pin 230 having a center axis which is substantially parallel with the respective center axes of the shafts 46 and 226. The cam actuating member 228 is thus rotatable on the first arm portion 224*a* of the bell crank lever 224 about the center axis of the pivotal pin 230 and is movable, together with the bell crank lever 224, relative to the cam shaft 46 on a vertical plane perpendicular to the center axes of the shafts 46 and 226. The cam actuating member 228 extends generally downwardly away from the pivotal pin 230 and has a lowermost hook portion 232 formed with a substantially semicircular notch 234 facing the pivotal pin 230, a guide surface 236 slanting from the lower end of the hook portion 232 and terminating in the notch 234, and a rounded projection 238 opposite to the guide surface 236. The notch 234 and guide surface 236 of the hook portion 232 are located and movable in the circular path of the pins 54 on the cam 48 about the center axis of the cam shaft 46 so that the hook portion 232 is capable of receiving one of the pins 54 either in the notch 234 as shown in FIG. 7 or on the guide surface 236 depending upon the relative angular positions of the cam 48 and the cam actuating member 228 about the center axes of the cam shaft 46 and the pivotal pin 230. The projection 238 of the hook portion 232 protrudes generally perpendicularly away from the cam shaft 46. The cam actuating member 228 thus configured is urged to turn counter-clockwise in FIG. 7 about the center axis of the pivotal pin 230 and accordingly has the hook portion 232 biased to move toward the cam shaft 46 by suitable biasing means such as a helical torsion spring 240 which is wound up around the pivotal pin 230 and which has one end portion retained to the first arm portion 224*a* of the bell crank lever 224 and the other end portion retained to the upper end portion of the cam actuating member 228 as shown.

The bell crank lever 224 has a land 242 fixedly mounted on one face of the first arm portion 224*a* thereof by suitable fastening means such as bolts 244. The land 242 has a substantially flat surface portion 246 which is found on or may be slightly inclined to a plane passing through the center axis of the stationary shaft 226 carrying the bell crank lever 224. The land 242 is further formed with a guide surface portion 248 which is inclined to the above mentioned surface portion 246. For the reason which will be understood as the description proceeds, the first arm portion 224*a* of the bell crank lever 224 is formed with a projection 250 which is directed generally downwardly from the arm portion 224*a* as illustrated. The bell crank lever 224 has further mounted at the leading end of its second arm portion 224*b* a roller 252 which is rotatable on a shaft 254 secured to the arm portion and having a center axis which is substantially parallel with the center axis of the stationary shaft 226 on which the bell crank lever 224 is mounted.

The intermittent-motion drive means 28' comprises an eccentric cam 134 securely mounted on a rotatable cam shaft 128 having a horizontal center axis substantially parallel with the center axis of the shaft 226 carrying the bell crank lever 224. The eccentric cam 134 has higher and lower semicircular lobe portions having respective vertices which are diametrically opposed to each other across the center axis of the cam shaft 128. The cam shaft 128 is operatively connected to a drive source through suitable torque transmission means such as the gear arrangement of the intermittent-motion drive means 28 of the embodiment of FIGS. 1 and 2 though not shown in FIG. 7 and is driven to rotate about the center axis of the cam shaft 128 at a predetermined velocity which is synchro to the velocities at which other rotatable or otherwise movable members and structures of the loom are to be driven. The eccentric cam 134 is herein assumed to be driven to make a full turn about the axis of the shaft 128 per weaving cycle of the loom, by way of example. The roller 252 on the second arm portion 224*b* of the above described bell crank lever 224 is engageable with the cam 134 and is thus rollable alternately on the higher and lower lobe portions of the cam 134 depending upon the angular position of the cam 134 about the center axis of the cam shaft 128 relative to the bell crank lever 224. The roller 252 on the bell crank lever 224 thus serves as a cam follower for the eccentric cam 134. When the eccentric cam 134 is rotated about the center axis of the cam shaft 128 with its higher and lower lobe portions alternately brought into rolling contact with the cam follower roller 252 on the bell crank lever 224, the cam follower roller 252 is alternately raised and lowered over the cam shaft 128 so that the bell crank lever 224 is caused to oscillate between clockwise and counter-clockwise extreme rotational positions about the center axis of the stationary shaft 226. The counter-clockwise and clockwise extreme rotational positions of the bell crank lever 224 are herein referred to as first and second limit angular positions, respectively, of the bell crank lever 224 about the center axis of the shaft 226. When the bell crank lever 224 is thus oscillated between the first and second angular positions about the axis of the shaft 226, the pivotal pin 230 at the leading end of the first arm portion 224*a* of the bell crank lever 224 is moved in an arc generally toward and away from the cam shaft 46 carrying the lobular cam 48. This causes the cam actuating member 128 to move generally upwardly and downwardly sidewise to the cam shaft 46 so that the hook portion 232 of the cam actuating member 228 is moved in the path of the pins 54 on the lobular cam 48 and drives the cam 48 to turn clockwise in FIG. 7 about the center axis of the cam shaft 46 through engagement between the hook portion 232 of the cam actuating member 228 and one of the pins 54 on the cam 48, as will be understood from the previous description regarding the embodiment of FIGS. 1 and 2.

The pattern card arrangement 30' is similar to each of its counterparts in the weft selector signal supply means 30 of the embodiment of FIGS. 1 and 2 and comprises a shaft 144 having a center axis substantially parallel with the center axis of the shaft 226 carrying the bell crank lever 224, a sprocket wheel 146 rotatable about the center axis of the shaft 144, an endless chain 148 passed on the sprocket wheel 146 and a peg 150 mounted on predetermined one of the teeth of the sprocket wheel 146. The sprocket wheel 146 is operatively connected to the previously mentioned driving source through suitable torque transmission means such as the gear arrangement of the weft selector signal supply means 30 of the embodiment of FIGS. 1 and 2 though not shown in FIG. 7 and is driven to turn about the center axis of the shaft 144 at a predetermined velocity related to the rotational velocity of the cam shaft 128 carrying the eccentric cam 134. For the purpose of description, the sprocket wheel 146 is herein assumed to have eight teeth and to be driven to make a one-eighth turn about the center axis of the shaft 144 per full turn of the eccentric cam 134 about the center axis of the cam shaft 134.

Figure 8:
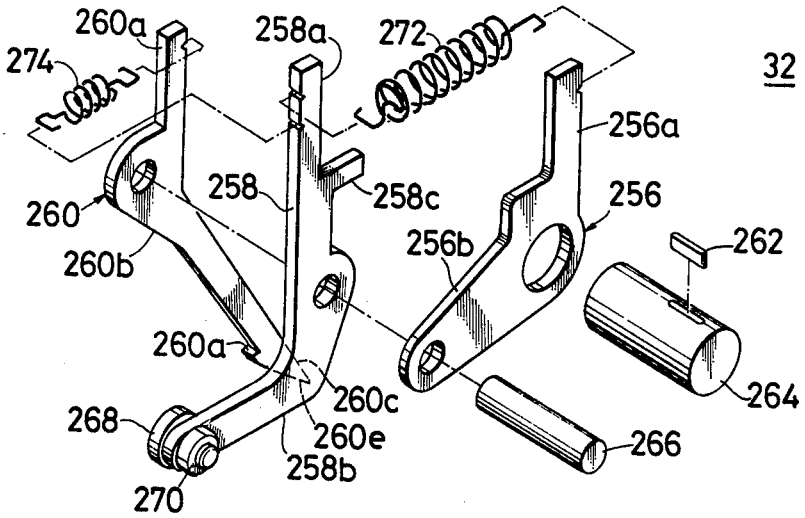
FIG. 8 is an exploded perspective view of the locking means incorporated into the embodiment of FIG. 7.

The locking means 32' is adapted to lock the previously described bell crank lever 224 and accordingly the cam actuating member 228 in response to the signal delivered from the above described pattern card arrangement 30', as in the embodiment of FIGS. 1 and 2. As illustrated to an enlarged scale in FIG. 8, the locking means 32' in its entirety is located in conjunction with the cam actuating means 26' and the pattern card arrangement 30' and largely comprises a stationary support member 256, a rocking member 258 and a clamping member 260. The support member 256 is fixedly mounted by means of a key 262 on a horizontal stationary shaft 264 having a center axis substantially parallel with the center axes of the respective shafts 144 and 226 of the pattern card arrangement 30' and the bell crank lever 224 and has an upper first arm portion **256*a* directed upwardly from the shaft 264 and a lower second arm portion 256*b* directed generally downwardly and sidewise from the shaft 262. The support member 256 has mounted at the leading end of its second arm portion 256*b* a pivotal pin 266 having a center axis substantially parallel with the center axis of the shaft 264. The rocking and clamping members 158 and 260 have respective intermediate fulcrum portions rotatably mounted on the pivotal pin 266 and are rotatable independently of each other about the center axis of the shaft 264. The support member 256, rocking member 258 and clamping member 260 are positioned relative to each other in such a manner that the clamping member 260 is interposed between the support member 256 and rocking member 258 and has one face thereof in slidable contact with the support member 256 and the other face thereof in slidable contact with the rocking member 258. The rocking member 258 has an upper first arm portion 258*a* extending upwardly from the fulcrum portion of the member 258, a lower second arm portion 258*b* extending generally downwardly and sidewise from the pivotal pin 266 from the fulcrum portion, and a land 258*c* formed on the upper first arm portion 258*a*. The lower second arm portion 258*b* has its leading end located and movable in proximity to the sprocket wheel 146 of the pattern card arrangement 30' and has mounted thereat a roller 268 which is rotatable on a shaft 270 mounted on the arm portion 258*b* and having a center axis substantially parallel with the center axes of the shaft 144 of the pattern card arrangement 30' and the shaft 264 supporting the support member 256. The rocking member 258 is as a whole urged to turn clockwise in the drawings about the center axis of the pivotal pin 266 and thus has the roller 268 forced onto the sprocket wheel 146 of the pattern card arrangement 30' by suitable biasing means such as a preloaded helical tension spring 272 which is anchored at one end to the upper first arm portion 256*a* of the support member 256 and at the other end to the upper first arm portion 258*a* of the rocking member 258. The rocking member 258 is thus rotatable about the center axis of the pivotal pin 266 between an upright first angular position and an inclined second angular position rotated counter-clockwise in the drawings against the force of the tension spring 272 as the roller 268 on the rocking member 258 rolls on the sprocket wheel 146 of the pattern card arrangemenr 30'. On the other hand, the clamping member 260 has an upper first arm portion 260*a* extending upwardly from the fulcrum portion of the clamping member and a lower second arm portion 260*b* extending from the fulcrum portion generally downwardly and sidewise from the center axis of the pivotal pin 266. The lower second arm portion 260*b* of the clamping member 260 has a latch portion 260*c* which is formed with an edge 260*d* facing the fulcrum portion of the clamping member and with a guide surface 260*e* slanting from the lower end of the latch portion 260*c* and terminating at the above mentioned edge 260*d*. The edge 260*d* of the latch portion 260*c* is engageable in a surface-to-surface fashion with the previously mentioned surface portion 246 of the land 242 on the bell crank lever 224 and, furthermore, the guide surface 260*e* of the latch portion 260*c* is slidable on the previously mentioned guide surface portion 248 of the land 242, depending upon the relation angular positions of the bell crank lever 224 and the clamping member 260 about the center axes of the shaft 226 and the pivotal pin 266, respectively. The previously mentioned projection 258*c* of the upper first arm portion 258*a* of the rocking member 258 is configured in such a manner as to be engageable with the upper first arm portion 260*a* of the clamping member 260 which is positioned in side-by-side relationship to the rocking member 258. The clamping member 260 is urged to turn about the center axis of the pivotal pin 266 counter-clockwise of the drawings relative to the rocking member 258 by suitable biasing means such as a preloaded helical tension spring 274 which is anchored at one end to the upper first arm portion 258*a* of the rocking member 258 and at the other end to the upper first arm portion 260*a* of the clamping member 260. For the purpose of having the springs 272 and 274 securely anchored to the members to which the springs are connected, each of the members 258, 260 and 262 may be formed with a notch or notches as shown in FIG. 8**.

On the other hand, the previously mentioned first cam retaining means 190 comprises an elongated lever 276 having one end portion rotatably mounted on the stationary shaft 194 supporting the bell crank lever 196 of the previously described link mechanism 24'. The lever 276 has an intermediate portion located and movable in proximity to the lower end of the lobular cam 48 and formed with a notch or recess located and movable in the circular path of the pins 54 on the cam 48. The notch or recess in the lever 276 is defined partly by a guide surface portion **276*a* facing the cam shaft 46 and slanting radially outwardly with respect to the direction of movement of the pins 54 on the cam 48 and a lateral edge portion 276*b* at which the guide surface portion 276*a* terminates. The guide surface portion 276*a* and the lateral edge portion 276*b* are shaped and located to be capable of receiving on either of them any one of the pins 54 depending upon the relative angular positions of the cam 48 and the lever 276 about the center axes of the cam shaft 46 and the shaft 194, respectively. When one of the pins 54 on the cam 54 is received on the lateral edge portion 276*b* of the lever 276 as shown in FIG. 7, the cam 48 is prevented from rotating clockwise of the drawings about the center axis of the cam shaft 46. The lever 276 has a leading end portion located below the hook portion 236 of the previously described cam actuating member 228 and has formed on the leading end portion thereof a projection 276*c* extending upwardly from the leading end portion. The projection 276*c* is angularly spaced apart from the intermediate portion of the lever 276 and has formed therebetween a curved notch portion 276*d* which is shaped and located to be engageable with the rounded projection 238 of the hook portion 232 of the cam actuating member 228 depending upon the relative angular positions of the cam actuating member 228 and the lever 276 about the center axis of the shaft 226 carrying the bell crank lever 224 and the center axis of the shaft 194 carrying the lever 276, respectively. The lever 276 thus configured and arranged is urged to turn about the center axis of the shaft 194 clockwise of the drawings, viz., toward the center axis of the cam shaft 46 by suitable biasing means connected between the lever 276 and the bell crank lever 224 of the cam actuating means 26', the biasing means being shown comprising a preloaded helical tension spring 278 which is anchored at one end to the leading end of the lever 276 by a spring retaining pin 280 and at the other end to the previously mentioned projection 250 of the upper first arm portion 224*a* of the bell crank lever 224 by a spring retaining pin 282. The tension spring 280 is, thus, operative not only to urge the lever 276 to turn clockwise of the drawings but to urge the bell crank lever 224 to turn clockwise of the drawings about the center axis of the shaft 226 so that the cam follower roller 252 mounted on the lower second arm portion 224*b* of the bell crank lever 224 is forced against the cam surface of the eccentric cam 134. If desired, the biasing means thus interconnecting the bell crank lever 224 and the lever 276 may be replaced with separate springs respectively connected to the bell crank lever 224 and the lever 276**, though not shown in the drawings.

While the first cam retaining means 190 is thus adapted to prevent clockwise rotation of the lobular cam 48 about the center axis of the cam shaft 46 when engagement is established between the lever 276 and one of the pins 54 on the cam 48, the second cam retaining means 192 is arranged to prevent the lobular cam 48 from turning in the opposite direction about the center axis of the cam shaft 46. As shown in FIG. 7, the second cam retaining means 192 comprises a lever 284 which is rotatable on a stationary shaft 286 having a center axis substantially parallel with the center axis of the cam shaft 46. The lever 284 has a leading end portion located and movable in proximity to the upper end of the lotational position of the lobular cam 48 and has a notch **284*a* formed in the leading end portion. The notch 284*a* is located and movable in the circular path of the pins 54 on the cam 48 and is thus capable of receiving therein any one of the pins 54 depending upon the relative angular positions of the cam 48 and the lever 284 about the center axes of the cam shaft 46 and the shaft 286, respectively. When, thus, one of the pins 54 on the cam 48 is captured in the notch 284*a* if the lever 284 as shown in FIG. 7, the cam 48 is prevented from rotating counter-clockwise of the drawings about the center axis of the cam shaft 46. The lever 284 is urged to turn clockwise of the drawings by suitable biasing means such as a preloaded helical torsion spring 288 which has one end portion securely wound up on the shaft 286 and the other end portion retained to the lever 284** as illustrated.

The operation of the second embodiment of the present invention thus constructed and arranged will be hereinafter described with reference to FIGS. 7 and 8 and further to FIGS. 9 to 13.

Throughout the operation of the apparatus, the eccentric cam 134 of the intermittent-motion drive means 28' is kept driven to rotate about the center axis of the cam shaft 128 at a predetermined fixed velocity related to the velocities at which the other rotatable and otherwise movable members and structures of the loom are driven, as previously mentioned. The rotation of the eccentric cam 134 is transmitted to the shaft 144 of the pattern card arrangement 30' and drives the sprocket wheel 146 to rotate about the center axis of the shaft 144 at a velocity equal to one eighth of the rotational velocity of the eccentric cam 134 as also mentioned previously. The sprocket wheel 146 therefore makes a one-eighth turn about the center axis of the shaft 144 and accordingly the individual teeth of the sprocket wheel 146 are brought into contact with the roller 268 on the rocking member 258 of the locking means 32' one after another as the eccentric cam 134 makes a full turn about the center axis of the cam shaft 128.

Figure 9:
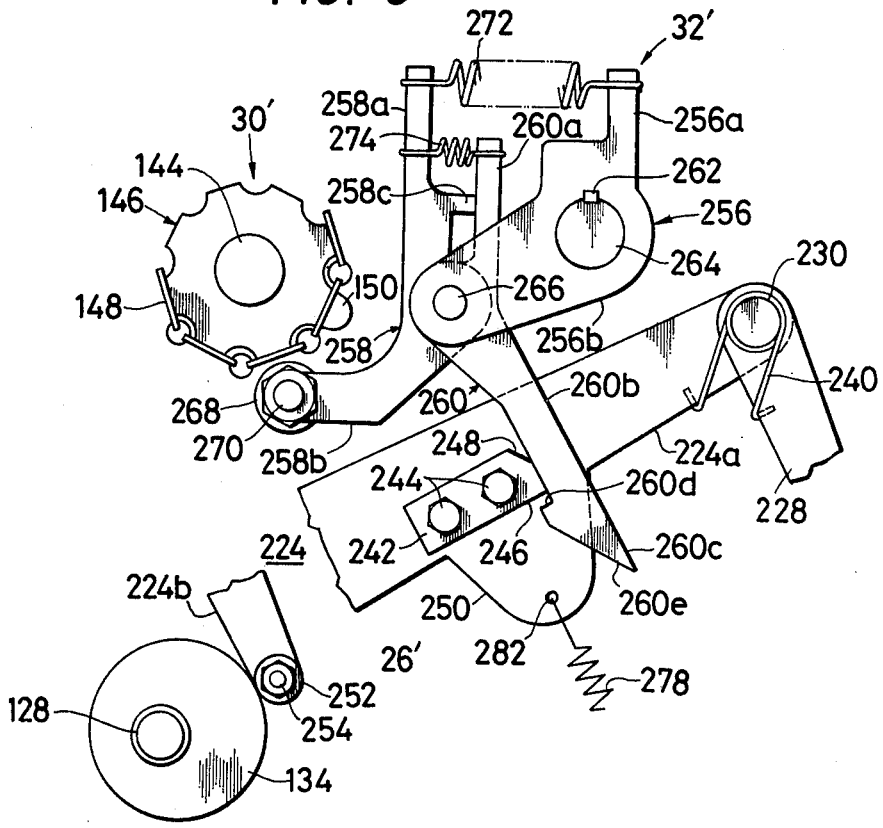
FIGS. 9 to 13 are fragmentary side elevational views showing various operative conditions of the embodiment illustrated in FIG. 7.
Figure 10:
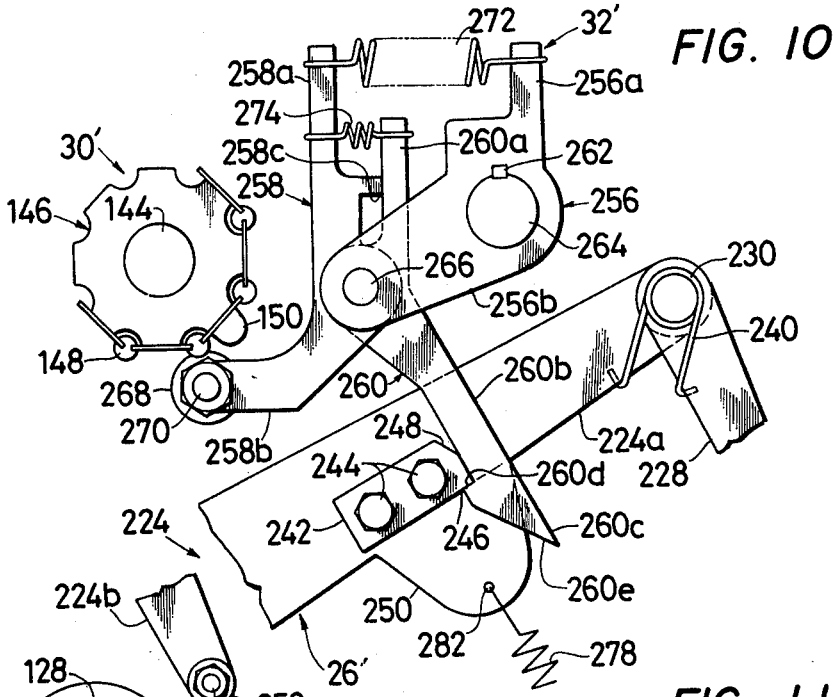

When the eccentric cam 134 is thus driven for rotation about the center axis of the cam shaft 128 and has its higher and lower cam lobe portions alternately brought into rolling contact at their respective vertices with the cam follower roller 252 on the bell crank lever 224, the cam follower roller 252 is alternately raised and lowered over the cam shaft 128 so that the bell crank lever 224 carrying the cam follower roller 252 is caused to oscillate between the previously mentioned first and second limit angular positions thereof about the center axis of the stationary shaft 226 on which the bell crank lever 224 is mounted. If, under these conditions, the sprocket wheel 146 of the pattern card arrangement 30' is in an angular position having one of its teeth in contact with the roller 268 on the rocking member 258 of the locking means 32', the rocking member 258 is held in the previously mentioned upright first angular position thereof about the center axis of the pivotal pin 266 on the support member 256 by the force of the tension spring 272, as illustrated in FIG. 9. When the rocking member 258 assumes the first angular position as above described, the clamping member 260 has its upper first arm portion **260*a* received on the projection 258*c* of the upper first arm portion 258*a* of the rocking member 258 and has about the center axis of the pivotal pin 266 an angular position having the edge 260*d* of its latch portion 260*c* located to be engageable with the land 242 on the upper first arm portion 224*a* of the bell crank lever 224. When the bell crank lever 224 is rotated about the center axis of the shaft 226 into the first limit angular position, viz., the counter-clockwise extreme rotational position thereof agsinst the force of the tension spring 278 with the eccentric cam 134 contacted by the cam follower roller 252 at the vertex of its higher cam lobe portion as shown in FIG. 9, the edge 260*d* of the latch portion 260*c* of the clamping member 260 is slightly spaced apart from the previously mentioned surface portion 246 of the land 242. When the eccentric cam 134 is further rotated about the center axis of the cam shaft 128 and the vertex of the higher cam lobe portion thereof is moved past the cam follower roller 252, the bell crank lever 224 is forced to slightly turn clockwise in the drawings about the center axis of the shaft 226 from its first limit angular position illustrated in FIG. 9 by the force of the tension spring 278 until the land 242 on the bell crank lever 224 has its surface portion 246 received on the edge 260*d* of the latch portion 260*c* of the clamping member 260 as shown in FIG. 10. The angular position of the bell crank lever 224 thus achieved when the land 242 has its surface portion 246 received on the edge 260*d* of the latch portion 260*c* of the clamping member 260 is herein referred to an allowance angular position of the bell crank lever 224 about the center axis of the shaft 226. When the clamping member 260 is held in the angular position having the edge 260*d* of its latch portion 260*c* located to be engageable with the surface portion 246 of the land 242, the bell crank lever 224 is slightly oscillated about the center axis of the shaft 226 between the first limit angular position illustrated in FIG. 9 and the above mentioned allowance angular position illustrated in FIG. 10 as the eccentric cam 134 is rotated into and out of the angular position having the higher lobe portion contacted at its vertex with the cam follower roller 252 on the bell crank lever 224**.

When the bell crank lever 224 is thus rotated into the first limit angular position thereof, the cam actuating member 228 extending generally downwardly from the leading end of the upper first arm portion 224*a* of the bell crank lever 224 is moved into the uppermost position thereof and has one of the pins 54 on the lobular cam 48 received in the notch 234 of its hook portion 232. When the lobular cam 48 is thus held in an angular position having one of the pins 54 received in the notch 234 of the hook portion 232 of the cam actuating member 228, one of the remaining pins 54 is received on the lateral edge portion 276*b* of the lever 276 of the first cam retaining means 190 and at the same time one of the still remaining pins 54 is captured in the notch 284*a* of the lever 284 of the second cam retaining means 192, as illustrated in FIG. 7. The cam 48 is therefore locked in the above mentioned angular position and is prevented from being rotated in either direction about the center axis of the cam shaft 46 even when the bell crank lever 224 is rotated about the center axis of the shaft 226 clockwise of the drawings into the above mentioned allowance angular position thereby the force of the tension spring 278 so that the cam actuating member 228 is slightly moved downwardly from the uppermost position thereof and accrodingly has its notch 234 slightly moved away from the pin 54 which has been received in the notch 234. When the bell crank lever 224 is being moved between the first and allowance angular positions about the center axis of the shaft 226 as above described, the hook portion 232 of the cam actuating member 228 is located short of the lever 276 of the first cam actuating means 192 so that the curved notch portion 276*d* of the lever 276 is kept away from the rounded projection 238 of the hook portion 232 of the cam actuating member 228 as shown in FIG. 7 even though the lever 276 is urged by the tension spring 278 toward an angular position to receive the rounded projection 238 in the notch portion 276*d* thereof.

Figure 11:
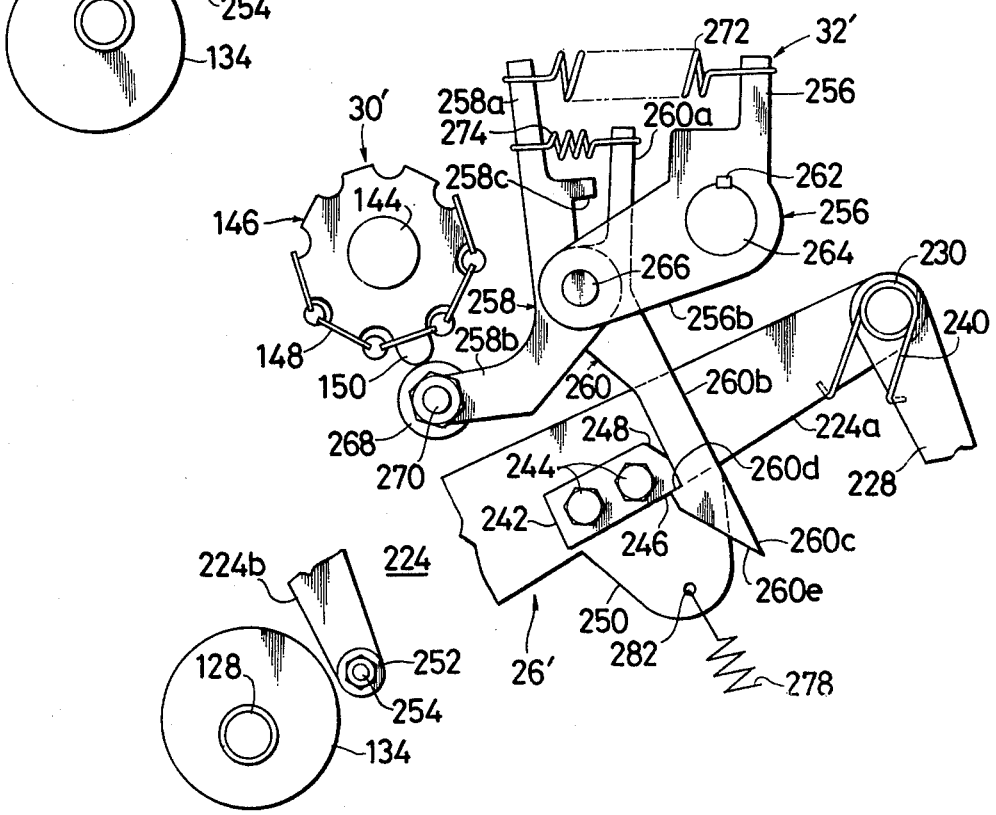
Figure 12:
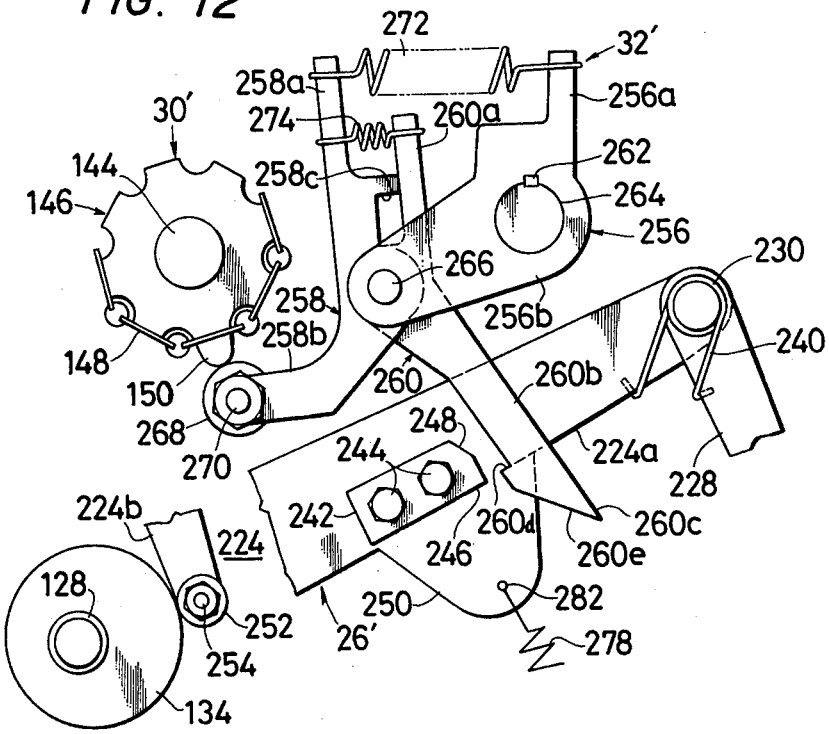
Figure 13:
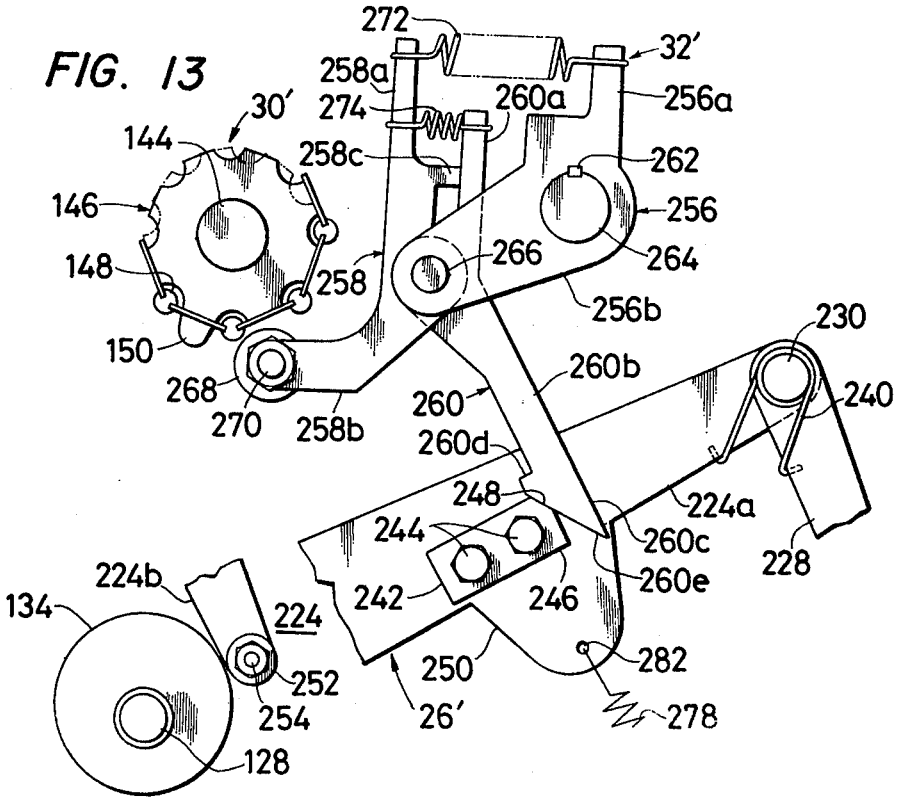

As the sprocket wheel 146 of the pattern card arrangement 30' is further rotated about the center axis of the shaft 144 and has the peg 150 contacted by the roller 268 on the rocking member 258 as illustrated in FIG. 11, the roller 268 is raised over the shaft 144 so that the rocking member 258 is rotated about the center axis of the pivotal pin 266 counter-clockwise of the drawings from the upright first angular position into the inclined second angular position against the force of the tension spring 272. If, under these conditions, the eccentric cam 134 is in an angular position having its lower cam lobe portion rolling on the cam follower roller 252 or its higher cam lobe portion rolling on the cam follower roller 252 at a point anterior or posterior to the vertex of the higher lobe portion, the bell crank lever 224 is held in the allowance angular position thereof and has the land 242 located to have its surface portion 246 closely received on the edge 260*d* of the latch portion 260*c* of the clamping member 260 by the force of the tension spring 278. The clamping member 260 is thus maintained in situ against the force of the tension spring 274 due to the frictional force established between the surface portion 246 of the land 242 and the edge 260*d* of the latch portion 260*c* of the clamping member 260 and has its upper first arm portion 260*a* kept disengaged from the projection 258*c* of the upper first arm portion 258*a* of the latter against the force of the tension spring 274 as shown in FIG. 11. It is, thus, important that the tension spring 274 be selected so that the force thereof is overcome by the frictional force produced between the land 242 and the latch portion 260*c* of the clamping member 260 when the latch portion 260*c* is forced against the surface portion 246 of the land 242 by the force of the tension spring 278. When the eccentric cam 134 then reaches an angular position having the vertex of its higher cam lobe portion contacted by the cam follower roller 252, the bell crank lever 224 is rotated about the center axis of the shaft 226 into the first limit angular position 246 disengaged from the edge 260*d* of the latch portion 260*c* of the clamping member 260, the clamping member 260 is allowed to turn counter-clockwise of the drawings about the center axis of the pivotal pin 266 by the force of the tension spring 274 until the upper first arm portion 260*a* thereof is for a second time brought into abutting engagement with the projection 258*c* of the upper first arm portion 258*a* of the rocking member 258 which is held in the inclined second angular position, as shown in FIG. 12. The bell crank lever 224 is now permitted to oscillate between the first and second limit angular positions thereof about the center axis of the shaft 226 as the eccentric cam 134 is rotated about the center axis of the cam shaft 128. As the bell crank lever 224 is thus oscillated between the first and second limit angular positions thereof, the cam actuating member 228 connected to the upper first arm portion 224*a* of the bell crank lever 224 is moved between the lowermost and uppermost positions, respectively, thereof. When the bell crank lever 224 is turned clockwise of the drawings from the second angular position thereof, the cam actuating member 228 is moved downwardly from the uppermost position thereof sidewise to the cam shaft 46 carrying the lobular cam 48. When the cam actuating member 228 is thus moved downwardly from the uppermost position thereof, the notch 234 of its hook portion 232 is moved away from the pin 54 which has been received in the notch 234 and the hook portion 232 has its guide surface 236 in sliding contact with the pin 54 which is located posterior to the pin 54 which has been caught in the notch 234. As the cam actuating member 228 is moved closer to the lowermost position thereof, the hook portion 232 thereof has its rounded projection 238 received in the notch portion 276*d* of the elongated lever 276 of the first cam retaining means 190 and forces the lever 276 downwardly. The lever 276 is thus caused to turn counter-clockwise in FIG. 7 against the force of the tension spring 278 which has been slackened by the clockwise rotation of the bell crank lever 224 toward the second limit angular position thereof. When the bell crank lever 224 reaches second limit angular position thereof and accordingly the cam actuating member 228 reaches the lowermost position thereof, the lever 276 of the first cam retaining means 190 is rotated about the center axis of the shaft 194 into an angular position having its lateral edge portion 276*b* disengaged from the pin 54 which has been received thereon and makes the cam 48 rotatable clockwise in the drawings about the center axis of the cam shaft 46. When the cam actuating member 228 is in the lowermost position thereof, the hook portion 232 thereof has captured in its notch 234 the pin 54 posterior to the pin 54 previously caught in the notch 234. As the bell crank lever 224 is rotated counter-clockwise from the second limit angular position about the center axis of the shaft 226 against the force of the tension spring 278, the cam actuating member 228 is moved back upwardly from the lowermost position so that the pin 54 now captured in the notch 234 of the hook portion 232 of the cam actuating member 228 is moved upwardly and causes the cam 48 to turn clockwise in the drawing about the center axis of the cam shaft 46. The cam 48 is in this fashion rotated through 60 degrees from its initial angular position about the center axis of the cam shaft 46 when the bell crank lever 224 makes one oscillatory motion about the center axis of the shaft 226 and accordingly the cam actuating member 228 makes one reciprocating motion. When the bell crank lever 224 is being moved back toward the first limit angular position about the center axis of the shaft 226 and accordingly the cam actuating member 228 is being moved back toward the uppermost position thereof, the hook portion 232 of the cam actuating member 228 has its rounded projection 238 withdrawn from the notch portion 276*d* of the elongated lever 276, which is therefore allowed to turn about the center axis of the shaft 194 toward its initial angular position by the force of the tension spring 278 so that the pin 54 posterior to the pin 54 previously received on the lateral edge portion 276*b* of the lever 276 slides on the guide surface portion 276*a* of the lever 276. When the bell crank lever 224 reaches the first limit angular position thereof about the center axis of the shaft 246, the lever 276 resumes its initial angular position about the center axis of the shaft 194 and has received on its lateral edge portion 276*b* the pin 54 newly engaged by the lever 276 so that the cam 48 is retained in the angular position newly reached. By the time the bell crank lever 224 reaches the first limit angular position thereof as above described, the sprocket wheel 146 of the pattern card arrangement 30′ is rotated about the center axis of the shaft 144 and has the peg 150 moved out of the position engaged by the roller 268 on the rocking member 258. The rocking member 258 is therefore allowed to rotate clockwise of the drawings back into the upright first angular position thereof about the center axis of the pivotal pin 266 by the force of the tension spring 272 so that the clamping member 260 having its first arm portion 260*a* held in contact with the projection 258*c* of the first arm portion 258*a* of the rocking member 258 is caused to turn clockwise of the drawings about the pivotal pin 266 together with the rocking member 258 and restores its initial angular position having the latch portion 260*c* located to be engageable with the land 242 on the bell crank lever 224. When the bell crank lever 224 reaches the first angular position thereof, the latch portion 260*c* of the clamping member 260 has its guide surface portion 260*e* received on the guide surface portion 248 of the land 242, as seen in FIG. 13. As the bell crank lever 224 is rotated counter-clockwise of the drawings toward the second angular position thereof about the center axis of the shaft 226 against the force of the tension spring 278, the land 242 on the bell crank lever 224 has its guide surface portion 248 in sliding contact with the guide surface 260*e* of the latch portion 260*c* of the clamping member 260 and is disengaged from the latch portion 260*c* when the bell crank lever 224 reaches the second angular position illustrated in FIG. 9. When the bell crank lever 224 is then driven to turn clockwise of the drawings from the second angular position thus reached, the land 242 on the bell crank lever 224 has its flat surface portion 246 received on the edge 260*d* of the latch portion 260*c* of the clamping member 260 as seen in FIG. 10 so that the bell crank lever 224 is locked in a condition slightly rockable about the center axis of the shaft 226 between the second angular position and the previously mentioned allowance angular position thereof as the eccentric cam 134 is driven to have its higher and lower lobe portions alternately brought into rolling contact with the cam follower roller 252 on the bell crank lever 224.

The lobular cam 48 of the cam unit 22′ is in this fashion driven to rotate clockwise in FIG. 7 through 60 degrees about the center axis of the cam shaft 46 every time the sprocket wheel 146 of the pattern card arrangement 30′ makes a full turn about the center axis of the shaft 144, viz., per eight turns of the eccentric shaft 134 about the center axis of the cam shaft 128. When the lobular cam 48 is thus rotated into an angular position having one of its bottom portions 52 in contact with the cam follower roller 198 on the bell crank lever 196 of the link mechanism 24′, the bell crank lever 196 is turned into the counter-clockwise extreme rotational position, viz., the previously mentioned first angular position about the center axis of the stationary shaft 194 so that the nozzle carrier 36 of the weft insertion unit 20′ is moved into the lower position thereof having the first weft shooting nozzle 34 located to have its center axis aligned with the weaving shed S and flush with the warp line L. The pick of the weft yarn which has been detained in the first weft shooting nozzle 34 is therefore shot into the weaving shed S by a jet stream of fluid spurting out of the nozzle 34 in each cycle of operation of the loom, as previously described in connection with the embodiment of FIGS. 1 and 2. When, on the other hand, the cam 48 assumes an angular position having one of its cam lobe portions 50 in contact with the cam follower roller 198, the bell crank lever 196 is held in the clockwise extreme rotational position, viz., the previously mentioned second angular position thereof so that the nozzle carrier 36 is held in the upper position thereof and has the second weft shooting nozzle 34′ located to have its center axis aligned with the weaving shed S and flush with the warp line L, as illustrated in FIG. 7. The pick of the weft yarn which has been detained in the second weft shooting nozzle 34′ is now shot into the weaving shed S in each cycle of operation of the loom. The nozzle carrier 36 is in this fashion moved between the upper and lower positions thereof relative to the weaving shed S and accordingly either of the weft yarns detained in the first and second weft shooting nozzles 34 and 34′ is selectively inserted into the weaving shed S in accordance with the signals delivered from the pattern card arrangement 30′, viz., each time the peg 150 on the sprocket wheel 146 of the pattern card arrangement is brought into contact with the roller 268 on the rocking member 258 of the locking means 32′.

Figure 14:
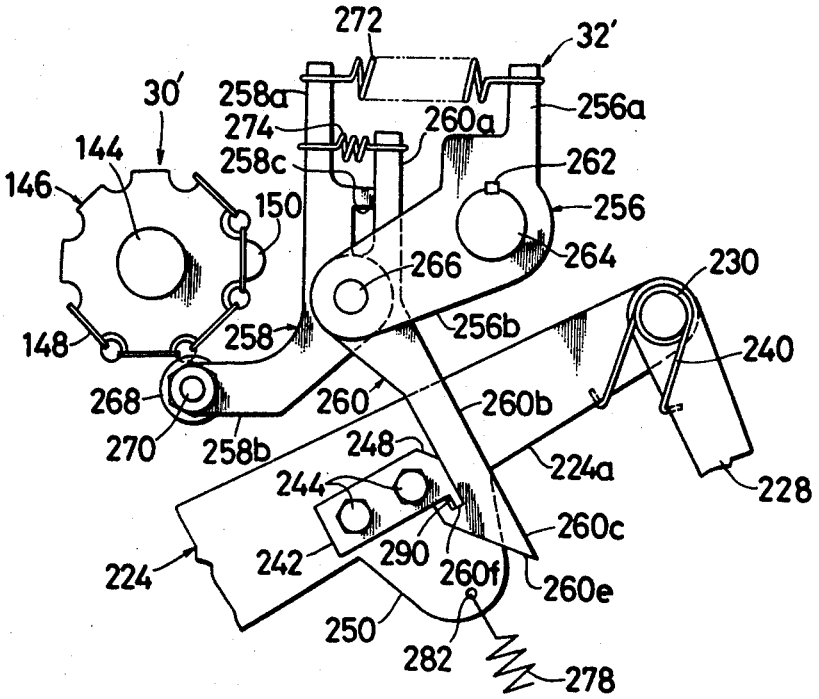
FIG. 14 is a view similar to FIG. 10 but shows a modification of the locking means of the embodiment of FIG. 7.

FIG. 14 illustrates a modification of the locking means 26′ in the above described embodiment. In the locking means illustrated in FIG. 14, the land 242 fixedly mounted on the upper first arm portion 224*a* of the bell crank lever 224 is formed with a projection 290 on its face opposite to the pivotal pin 266 supporting the rocking and clamping members 258 and 260 and at the end of the above mentioned face closest to the pivotal pin 230 supporting the cam actuating member 228. On the other hand, the clamping member 260 has formed in the latch portion 260*c* thereof a notch 260*f* which is located and configured to be capable of receiving therein the above mentioned projection 290 of the land 242. The projection 290 of the land 242 is received in the notch 260*e* when the bell crank lever 224 is held in the previously mentioned allowance angular position thereof and at the same time the rocking member 258 is held in the upright first angular position forcing the clamping member 260 in the angular position engageable with the land 242 by the engagement between the projection 258*c* of the first arm portion 258*a* of the rocking member 258 and the first arm portion 260*a* of the clamping member 260, as shown. The projection 290 of the land 242 is sized conformingly to the angle between the second angular position and the allowance angular position of the bell crank lever 224 about the center axis of the shaft 226 (FIG. 7). When, thus, the bell crank lever 224 is turned counterclockwise in FIG. 14 from the allowance angular position into the second angular position thereof about the center axis of the shaft 226, the projection 290 of the land 242 is withdrawn from the notch 290*f* in the latch portion 260*c* of the clamping member 260, which is accordingly disengageable from the land 242 on the bell crank lever 224.

While the engagement between the land 242 and the clamping member 260 is achieved by the surface-to-surface contact between the surface portion 246 of the former and the edge 260*d* of the latch portion 260*c* of the latter in the embodiment of FIG. 7, such engagement is achieved in the mating engagement between the projection 290 of the land 242 and the latch portion 260*c* of the clamping member 260 in the embodiment of FIG. 14. In each of such arrangements, there is an appreciable time interval between the instant at which the clamping member 260 is made ready to be disengaged from the bell crank lever 224 with the rocking member 258 moved into the inclined second angular position (FIG. 11) and the instant at which the clamping member 260 is permitted to be disengaged from the bell crank lever 224. The shocks and impacts that would be produced when the bell crank lever 224 is actuated to move from the second angular position toward the first angular position in response to the engagement between the peg 150 of the pattern card arrangement 30' and the rocking member 258 are in this fashion broadly lessened or eliminated. It is apparent that such an effect is also achieved in the embodiment previously described with reference to FIGS. 1 and 2.

While the motions of the cam assembly 22 or cam unit 22' have been described to be utilized solely for the selection of the weft yarns to be inserted into the weaving shed, the arrangement including the cam assembly or unit 22 or 22', link mechanism 24 or 24', cam actuating means 26 or 26', intermittent-motion drive means 28 or 28', signal supply means 30 or 30' and locking means 32 or 32' as hereinbefore described may be used for the control of the weft yarn drawing-off and length measuring mechanism and/or the weft yarn retaining mechanism of the weaving loom.

What is claimed is:

1. An apparatus for selectively inserting weft yarns into the shed in a weaving loom, comprising, in combination, a weft insertion unit including a plurality of weft shooting members each movable into a position aligned with said shed, weft selector cam means having a plurality of conditions respectively operative to hold said weft shooting members in alignment with said shed, a link mechanism operatively connecting said cam means to said weft insertion unit for moving selected one of said weft shooting nozzles into the position aligned with said shed when said cam means is actuated from one of said conditions into another, cam actuating means operative to drive said cam means between said conditions thereof in each cycle of operation of the loom, intermittent-motion drive means for driving said cam actuating means alternately into first and second conditions engaging said cam means in different positional relationships to the cam means, the cam actuating means being operative to drive said cam means between said conditions thereof when the cam actuating means is driven from said first condition into said second condition and thereafter from the second condition back into the first condition by said intermittent-motion drive means, weft selector signal supply means storing signals representative of a predetermined schedule in accordance with which the weft yarns are to be selectively inserted into said shed, locking means responsive to the signals delivered from said signal supply means for locking said cam actuating means in a condition inoperative to drive said cam means in response to one signal from the signal supply means and releasing the cam actuating means from the inoperative condition in response to another signal from the signal supply means, the cam actuating means in the inoperative condition thereof being held in engagement with said cam means and said intermittent-motion drive means and having a predetermined allowance of movement to be movable from said first condition toward said second condition thereof and then backwardly to the first condition, and said locking means having means operative to release said cam actuating means at a predetermined time interval corresponding to said predetermined allowance of movement after said another signal is impressed on said locking means.

2. An apparatus as set forth in claim 1, in which said cam means comprises lobular cams respectively associated with prescribed ones of said weft shooting members and rotatable independently of each other about a common fixed axis, each of said cams having a plurality of cam lobe portions substantially equiangularly spaced apart from each other across bottom portions about said fixed axis and having substantially equal radii from the axis, the bottom portions of all of said cams having substantially equal radii from said fixed axis and the respective radii of the cam lobe portions of the cams being different from each other and in which said link mechanism comprises cam followers respectively engageable with said lobular cams for being raised and lowered over said fixed axis independently of each other depending upon the respective angular positions of said cams relative to the associated cam followers.

3. An apparatus as set forth in claim 2, in which each of said lobular cams has fixed on one end face thereof pins projecting from said end face substantially in parallel with said fixed axis and arranged substantially symmetrically about the fixed axis, said cam actuating means comprising cam actuating units each engageable with the pins on each of said cams and movable with respect to said fixed axis for turning each of the pins on the associated cam through an angle equal to the central angle between every neighboring two of the pins about said fixed axis and thereby driving the associated cam to rotate through said angle about said fixed axis in each cycle of operation provided the cam actuating unit is disengaged from said locking means.

4. An apparatus as set forth in claim 3, in which said cam actuating units comprises rockers rotatable independently of each other about a common fixed axis substantially parallel with the axis of rotation of said cams and cam actuating members which are respectively rotatable on said rockers about respective axes substantially parallel with said axis of rotation of said cams and movable with sais rockers, respectively, and which are respectively associated with said cams so that each of the cam acutating members is engageable with the pins on the associated cam, each of said rockers being rotatable about the axis of rotation thereof between a first limit angular position having the associated cam actuating member in a position engaging one of the pins on the associated cam and a second limit angular position having the associated cam actuating member in a position engaging the pin next to said one of the pins, said rocker being operative to move each of the pins on the associated cam through said angle per oscillatory motion of the rocker from said first limit angular position to said second limit angular position and back from the second limit angular position into the first limit angular position thereof.

5. An apparatus as set forth in claim 4, in which said locking means comprises clamping members respectively associated with said rockers and rotatable independently of each other about a common fixed axis substantially parallel with the axis of rotation of said cams, surface portions respectively fast on said rockers and engageable with said clamping members, respectively, each of said clamping members having about the axis of rotation thereof a lockable angular position engageable with the surface portion on the associated rocker and being in locking engagement with the surface portion when the clamping member is in said lockable angular position thereof and simultaneously the associated rocker is in an angular position slightly turned away from said first limit angular position toward said second limit angular position thereof about the axis of rotation of the clamping member, rocking members respectively associated with said clamping members and rotatable independently of each other about the common axis of rotation of the clamping members, first biasing means connected between each of said clamping members and each of the associated rocking members for urging the former to turn about the axis of rotation thereof in a direction away from said lockable angular position thereof, the biasing force of said first biasing means being variable depending upon the relative angular positions of the clamping and rocking members connected by the first biasing means, each of said rocking members being rotatable about the axis of rotation thereof between a first angular position producing a smaller biasing force in said first biasing means and a second angular position producing a greater biasing force in the first biasing means, each rocking member being moved between said first and second angular positions thereof in response to the signals from said signal supply means, and second biasing means for urging each of said rocking members toward said first angular position thereof.

6. An apparatus as set forth in claim 5, in which each of said cam actuating units further comprises biasing means for urging each of said rockers to turn about the axis of rotation thereof away from said first limit angular position toward said second limit angular position thereof so that the rocker is forced into engagement with said surface portion on the associated rocker by a force exerted by the biasing means of the cam actuating unit on the associated rocker, said first biasing means of said locking unit being selected so that said smaller beasing force thereof is overcome by said force exerted on said surface portion by the biasing force of said cam actuating unit.

7. An apparatus as set forth in claim 6, in which said locking means further comprises first stop means for preventing each of said clamping members from being rotated beyond said lockable angular posion thereof about the axis of rotation of the clamping member when the associated rocking member is rotated into said first angular position thereof, and second stop means fast on each of said rocking members and engageable with the associated clamping member for preventing the rocking member from being rotated beyond said first angular position thereof about the axis of rotation thereof by the force of said second biasing means, said second stop means being in engagement with the associated clamping member irrespective of the angular position of the associated rocking member when the clamping member is disengaged from said surface portion of the associated rocker.

8. An apparatus as set forth in claim 2, in which said link mechanism further comprises a plurality of rockers rotatable together with each other about a fixed axis which is substantially parallel with the axis of rotation of said cams, said cam followers being constituted by rollers respectively mounted on said rockers and rotatable about respective axes substantially parallel with the axis of rotation of said cams and in line with each other, each of the rollers being rollable on the cam surface of the associated cam depending upon the angular position of the cam relative to the associated rocker.

9. An apparatus as set forth in claim 2, in which said cam means further comprises a circular cam rotatable independently of said lobular cams about said fixed axis and having a radius substantially equal to the radii of said bottom portions of said lubular cams and in which said link mechanism further comprises a cam follower engageable with said circular cam for providing operative connection between the circular cam and one of said weft shooting members.

10. An apparatus as set forth in claim 9, in which said link mechanism further comprises a plurality of rockers rotatable together with each other about a fixed axis substantially parallel with the axis of rotation of said cams, said cam followers being constituted by rollers respectively mounted on said rockers and rotatable about respective axes substantially parallel with the axis of rotation of said lobular and circular cams and in line with each other, said rollers being respectively rollable on the cam surfaces of the associated lobular and circular cams depending upon the respective angular positions of the cams relative to the associated rockers.

11. An apparatus as set forth in claim 10, in which said weft insertion unit further comprises a carrier on which said weft shooting members are jointly mounted and which is movable on a plane substantially parallel with the axis of rotation of said cams between positions respectively having said weft shooting members located in alignment with said shed, said link mechanism further comprising a lever rotatable about a fixed axis substantially parallel with the axis of rotation of said cams and operatively connected to said carrier and jointly to said rockers for converting the rotational motions of the rockers to the movement of said carrier on said plane.

12. An apparatus as set forth in claim 2, in which said lobular cam has fixed on one end face thereof pins projecting from said end face substantially in parallel with said fixed axis and arranged substantially in symmetry about the axis, said cam actuating means being engageable with said pins and movable with respect to said fixed axis for turning each of the pins through an angle equal to to the central angle between every neighboring two of the pins about said fixed axis and thereby driving said cam to rotate through said angle about said fixed axis in each cycle of operation provided said cam actuating means is disengaged from said locking means.

13. An apparatus as set forth in claim 12, in which said cam actuating means comprises at least one bell crank lever rotatable about a fixed axis substantially parallel with said axis of said cam and a cam actuating member rotatable on said bell crank lever about a fixed axis substantially parallel with the axis of rotation of said cam and engageable with the pins on the cam, said bell crank lever being rotatable about the axis of rotation thereof between a first limit angular position having said cam actuating member in a position engaging one of said pins on the cam and a second limit angular position having the cam actuating member in a position engaging the pin next to said one of the pins, said bell crank lever being operative to move said pins through said angle per oscillatory motion of the bell crank lever from said first limit angular position to said second limit angular position and back from the second limit angular position into the first limit angular position thereof.

14. An apparatus as set forth in claim 13, in which said locking means comprises a clamping member rotatable about a fixed axis substantially parallel with the axis of rotation of said cam, a land on said bell crank lever and engageable with said clamping member depending upon the relative angular positions of the clamping member and said bell crank lever, said clamping member having about the axis of rotation thereof an angular position engageable with the land on said bell crank lever and being in locking engagement with the land when the clamping member is in said angular position thereof and simultaneously said bell crank lever is in an allowance angular position slightly turned away from said first limit angular position toward said second limit angular position thereof about the axis of rotation of the bell crank lever, a rocking member rotatable about said axis of rotation of the clamping member, a rocking member rotatable about a fixed axis identical with the axis of rotation of said clamping member, first biasing means connected between said clamping and rocking members for urging the clamping member to turn away from said angular position thereof about the axis of rotation thereof, the biasing force of the first biasing means being variable depending upon the relative angular positions of the clamping and rocking members, said rocking member being rotatable about the axis of rotation thereof between a first angular position producing a smaller biasing force in said first biasing means and a second angular position producing a greater biasing force in the biasing means, second biasing means for urging said rocking member toward said first angular position thereof, third biasing means for urging said bell crank lever toward said first angular position thereof about the axis of rotation thereof, and stop means fast on said rocking member and engageable with said clamping member for preventing the rocking member from being rotated beyond said first angular position thereof by the force of said second biasing means, said stop means being in engagement with said clamping member irrespective of the angular position of the rocking member when said clamping member is disengaged from said land on said bell crank lever.

15. An apparatus as set forth in claim 14, in which said land on said bell crank lever has a surface portion engageable with said clamping member, said clamping member being in said locking engagement with said land by surface-to-surface contact with said surface portion of the land and forced against the surface portion by the force of said third biasing means when the clamping member is in said angular position thereof and simultaneously said bell crank lever is in said allowance angular position thereof, said first biasing means being selected so that said smaller biasing force thereof is overcome by the force exerted between said surface portion and said clamping member by said third biasing means.

16. An apparatus as set forth in claim 14, in which said land is formed with a projection and said clamping member is formed with a notch receivable said projection therein, said clamping member being in said locking engagement with said land with said projection received in said notch when said clamping member is in said angular position thereof and simultaneously said bell crank lever is in said allowance angular position by the force of said third biasing means, said projection being withdrawn from said notch when the bell crank lever is in said first limit position thereof.

17. An apparatus as set forth in claim 14, further comprising cam retaining means having an angular position engageable with one of said pins on said cam and connected by said third biasing means to said bell crank lever for being urged toward said angular position thereof, said cam retaining means being operative to prevent said cam from being rotated in one direction about said axis of rotation thereof when held in said angular position thereof, said cam actuating member being engageable with said cam retaining means for moving the cam retaining means out of said angular position thereof when said bell crank lever is moved into said second limit angular position thereof against the force of said third biasing means, said direction being the direction of rotation of the cam driven by said cam actuating means.

18. An apparatus as set forth in claim 17, further comprising cam retaining means having an angular position engageable with one of said pins on said cam and urged toward said angular position thereof for being operative to prevent said cam from being rotated in the other direction about the axis of rotation thereof when held in said angular position thereof.

19. An apparatus as set forth in claim 1, in which said cam means comprises at least one lobular cam rotatable about a fixed axis and formed with a plurality of cam lobe portions substantially equiangularly spaced apart from each other accross bottom portions about said axis and having substantially equal radii from the axis, said bottom portions having from said axis substantially equal radii smaller than said radii of said cam lobe portions, and in which said link mechanism comprises a cam follower held in contact with the cam surface of said lobular cam for being alternately raised and lowered over said fixed axis depending upon the angular position of said cam relative to said cam follower.

* * * * *